US011927024B2

(12) United States Patent
Morimura et al.

(10) Patent No.: US 11,927,024 B2
(45) Date of Patent: Mar. 12, 2024

(54) BINDING MACHINE

(71) Applicant: MAX CO., LTD., Tokyo (JP)

(72) Inventors: Kouichirou Morimura, Tokyo (JP); Yusuke Yoshida, Tokyo (JP); Takahiro Ito, Tokyo (JP); Hiroki Ishiguro, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 17/390,056

(22) Filed: Jul. 30, 2021

(65) Prior Publication Data

US 2022/0034110 A1 Feb. 3, 2022

(30) Foreign Application Priority Data

Jul. 31, 2020 (JP) ..... 2020-131159
Apr. 16, 2021 (JP) ..... 2021-069933

(51) Int. Cl.
*E04G 21/12* (2006.01)
*B65B 13/28* (2006.01)

(52) U.S. Cl.
CPC ..... *E04G 21/123* (2013.01); *B65B 13/285* (2013.01)

(58) Field of Classification Search
CPC ..... B21F 15/02; B21F 15/04; E04G 21/122; E04G 21/123; B65B 13/025; B65B 13/04; B65B 13/08; B65B 13/14
See application file for complete search history.

(56) References Cited

U.S. PATENT DOCUMENTS 5,871,036 A 2/1999 Murayama et al.
5,944,064 A 8/1999 Saito et al.
5,983,473 A 11/1999 Yuguchi et al.
2004/0244866 A1 12/2004 Ishikawa et al.
2005/0224131 A1 10/2005 Ishii et al.
(Continued)

FOREIGN PATENT DOCUMENTS

CA 3049943 A1 8/2018
CN 1184521 A 6/1998
(Continued)

OTHER PUBLICATIONS

Extended European Search Report dated Jan. 5, 2022, issued by the European Patent Office in the corresponding European Patent Application No. 21188693.2-1005. (9 pages).
(Continued)

*Primary Examiner* — Debra M Sullivan
(74) *Attorney, Agent, or Firm* — Banner & Witcoff, Ltd.

(57) ABSTRACT

A binding machine includes: a wire feeding unit configured to feed a wire; a curl forming unit configured to form a feeding path of the wire along which the wire fed in a first direction by the wire feeding unit is wound around an object; and a binding unit configured to twist the wire fed in first direction by the wire feeding unit and wound on the object. The wire feeding unit includes a pair of feeding members configured to sandwich the wire and to feed the wire by a rotating operation, and a feeding motor configured to drive the feeding members. The binding machine further includes a control unit configured to control the wire feeding unit. The control unit is configured to control the wire feeding unit to enable the wire sandwiched by the feeding members to be discharged from the feeding members.

19 Claims, 18 Drawing Sheets

(56) References Cited

U.S. PATENT DOCUMENTS

| | | | | |
|---|---|---|---|---|
| 2006/0011254 | A1 | 1/2006 | Yokochi et al. | |
| 2018/0207710 | A1 | 7/2018 | Itagaki et al. | |
| 2021/0180347 | A1* | 6/2021 | Mizuno | B21F 15/06 |
| 2022/0325543 | A1* | 10/2022 | Matsuno | B65H 75/14 |

FOREIGN PATENT DOCUMENTS

| | | | |
|---|---|---|---|
| CN | 1688481 | A | 10/2005 |
| CN | 102190092 | A | 9/2011 |
| CN | 106395021 | A | 2/2017 |
| CN | 208036703 | U | 11/2018 |
| EP | 3327222 | A1 | 5/2018 |
| JP | H07-034110 | Y2 | 8/1995 |
| JP | H10-250703 | A | 9/1998 |
| JP | 2003-034305 | A | 2/2003 |
| RU | 2016815 | C1 | 7/1994 |
| SU | 815235 | A1 | 3/1981 |
| TW | 312672 | B | 8/1997 |
| WO | 03-080445 | A1 | 10/2003 |

OTHER PUBLICATIONS

Nov. 20, 2023—(RU) Official Action—App 2021122734.

* cited by examiner

BINDING MACHINE

CROSS-REFERENCE TO RELATED APPLICATIONS

This application claims priority to Japanese Patent Applications No. 2020-131159 filed on Jul. 31, 2020 and No. 2021-069933 filed on Apr. 16, 2021, the contents of which is incorporated herein by reference.

TECHNICAL FIELD

The present disclosure relates to a binding machine configured to bind an object s a reinforcing bar with a wire.

BACKGROUND ART

For concrete buildings, reinforcing bars are used so as to improve strength. The reinforcing bars are bound with wires so that the reinforcing bars do not deviate from predetermined positions during concrete placement.

In the related art, suggested is a binding machine referred to as a reinforcing bar binding machine configured to wind two or more reinforcing bars with a wire, and to twist the wire wound on the reinforcing bars, thereby binding the two or more reinforcing bars with the wire. The binding machine includes a binding wire feeding mechanism configured to deliver the wire wound on a reel and to wind the binding wire on the reinforcing bars, a gripping mechanism configured to grip the wire wound on the reinforcing bars, and a binding wire twisting mechanism configured to twist the wire by rotationally driving the gripping mechanism, and the wire feeding mechanism, the gripping mechanism and the wire twisting mechanism sequentially operate by a trigger operation, so that a binding operation of one cycle is performed.

When binding the reinforcing bars with the wire, if the binding is loosened, the reinforcing bars deviate each other, so that it is required to firmly maintain the reinforcing bars. Therefore, suggested is a technology of feeding the wire wound around the reinforcing bars in a reverse direction and winding the wire on the reinforcing bars (for example, refer to JP 2003-34305 A). In addition, suggested is a technology of feeding the wire by a pair of rollers configured to rotationally drive (for example, refer to JP H07-34110 Y).

In a configuration where the wire is sandwiched and fed by the air of rollers, the wire is fed by a friction force generated between the rollers and the wire.

In order to obtain the friction force enough to feed the wire, it is necessary to increase a force of the spring for pressing the pair of rollers in a direction of coming close to each other. However, when the force of the spring for pressing the pair of rollers in the direction of coming close to each other is increased, it is difficult to move the pair of rollers in a direction of separating from each other by human force. In order to discharge the wire from between the pair of rollers, it is necessary to move the pair of rollers in the direction of separating from each other by human force, which hinders feeding of the wire with a strong force.

SUMMARY OF INVENTION

The present invention has been made to address the above issue, and an object thereof is to provide a binding machine capable of discharging a wire even when a pressing force of pressing a pair of feeding members in a direction of coming close to each other is increased.

According to an embodiment of the present invention, there is provided a binding machine includes: a wire feeding unit configured to feed a wire; a curl forming unit configured to form a feeding path of the wire along which the wire fed in a first direction by the wire feeding unit is wound around an object; and a binding unit configured to twist the wire fed in first direction by the wire feeding unit and wound on the object. The wire feeding unit includes a pair of feeding members configured to sandwich the wire and to feed the wire by a rotating operation, and a feeding motor configured to drive the feeding members. The binding machine further includes a control unit configured to control the wire feeding unit. The control unit is configured to control the wire feeding unit to enable the wire sandwiched by the feeding members to be discharged from the feeding members.

According to the embodiment of the present invention, the wire sandwiched by the feeding members can be discharged by controlling the wire feeding unit.

The wire W can be discharged without moving the pair of feeding members in a direction of separating from each other with human force.

DESCRIPTION OF EMBODIMENTS

Hereinafter, an example of a reinforcing bar binding machine that is an embodiment of the binding machine of the present invention will be described with reference to the drawings.

<Configuration Example of Reinforcing Bar Binding Machine>

Figure 1:
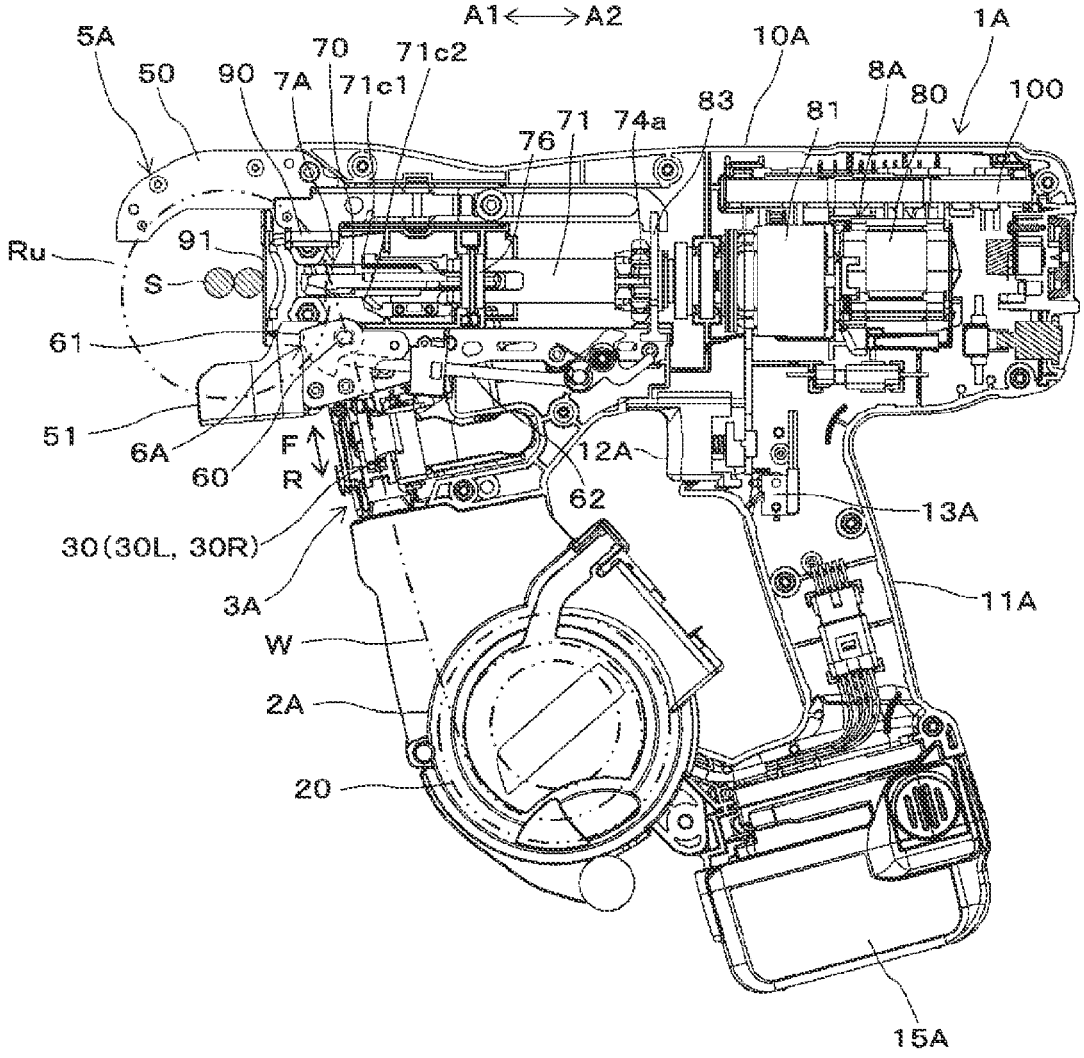
FIG. 1 is a view showing an example of an entire configuration of a reinforcing bar binding machine, as seen from a side.

FIG. 1 is a view showing an example of an entire configuration of a reinforcing bar binding machine, as seen from a side. A reinforcing bar binding machine 1A has such a shape that an operator grips with a hand, and includes a main body part 10A and a handle part 11A.

The reinforcing bar binding machine 1A is configured to feed a wire W in a forward direction denoted with an arrow F, to wind the wire around reinforcing bars S, which are a to-be-bound object, to teed the wire W wound around the reinforcing bars S in a reverse direction denoted with an arrow R, to wind the wire on the reinforcing bars S, and to twist the wire W, thereby binding the reinforcing bars S with the wire W.

In order to implement the above functions, the reinforcing bar binding machine 1A includes a magazine 2A in which the wire W is accommodated, and a wire feeding unit 3A configured to feed the wire W. The reinforcing bar binding machine 1A also includes a curl forming unit 5A configured to form a path along which the wire W fed by the wire feeding unit 3A is to be wound around the reinforcing bars S, and a cutting unit 6A configured to cut the wire W wound on the reinforcing bars S. The reinforcing bar binding machine 1A also includes a binding unit 7A configured to twist the wire W wound on the reinforcing bars S, and a drive unit 8A configured to drive the binding unit 7A.

In the magazine 2A, a reel 20 on which the long wire W is wound to be reeled out is rotatably and detachably accommodated. For the wire W, a wire made of a plastically deformable metal wire, a wire having a metal wire covered with a resin, a twisted wire or the like are used. The reel 20 is configured so that one or more wires W are wound on a hub part (not shown) and can be reeled out from the reel 20 at the same time.

The wire feeding unit 3A includes, as a pair of feeding members configured to sandwich and feed one wire W or a plurality of wires W aligned in parallel, a pair of feeding gears 30 (a first feeding gear 30L and a second feeding gear 30R) configured to feed the wire W by a rotating operation. In the wire feeding unit 3A, a rotating operation of a feeding motor (which will be described later) is transmitted to rotate the feeding gears 30. Thereby, the wire feeding unit 3A feeds the wire W sandwiched between the pair of feeding gears 30 along an extension direction of the wire W. In a configuration where a plurality of, for example, two wires W are fed, the two wires W are fed aligned in parallel.

The curl forming unit 5A includes a curl guide 50, which is an example of the first guide part configured to curl the wire W that is fed by the wire feeding unit 3A, and an induction guide 51, which is an example of the second guide part configured to guide the wire W curled by the curl guide 50 toward the binding unit 7A. In the reinforcing bar binding machine 1A, a path of the wire W that is fed by the wire feeding unit 3A is regulated by the curl forming unit 5A, so that a locus of the wire W becomes a loop Ru as shown with a broken line in FIG. 1 and the wire W is thus wound around the reinforcing bars S.

The cutting unit 6A includes a fixed blade part 60, a movable blade part 61 configured to cut the wire W in cooperation with the fixed blade part 60, and a transmission mechanism 62 configured to transmit an operation of the binding unit 7A to the movable blade part 61. The cutting unit 6A is configured to cut the wire W by a rotating operation of the movable blade part 61 about the fixed blade part 60, which is a support point. The transmission mechanism 62 is configured to transmit an operation of the binding unit 7A to the movable blade part 61 via a movable member 83 and to rotate the movable blade part 61 in conjunction with an operation of the binding unit 7A, thereby cutting the wire W.

The binding unit 7A includes a wire engaging body 70 to which the wire W is engaged. A detailed embodiment of the binding unit 7A will be described later. The drive unit 8A includes a motor 80, and a decelerator 81 configured to perform deceleration and amplification of torque.

The reinforcing bar binding machine 1A includes a feeding regulation part 90 against which a tip end of the wire W is butted, on a feeding path of the wire W that is engaged by the wire engaging body 70. In the reinforcing bar binding machine TA, the curl guide 50 and the induction guide 51 of the curl forming unit 5A are provided at an end portion on a front side of the main body part 10A. In the reinforcing bar binding machine 1A, a butting part 91 against which the reinforcing bars S are to be butted is provided at the end portion on the front side of the main body part 10A and between the curl guide 50 and the induction guide 51.

In the reinforcing bar binding machine 1A, the handle part 11A extends downwardly from the main body part 10A. Also, a battery 15 is detachably mounted to a lower part of the handle part 11A. Also, the magazine 2A of the reinforcing bar binding machine 1A is provided in front of the handle part 11A. In the main body part 10A of the reinforcing bar binding machine 1A, the wire feeding unit 3A, the cutting unit 6A, the binding unit 7A, the drive unit 8A configured to drive the binding unit 7A, and the like are accommodated.

A trigger 12A is provided on a front side of the handle part 11A of the reinforcing bar binding machine 1A, and a switch 13A is provided inside the handle part 11A. In addition, the main body part 10A is provided with a substrate 100 on which a circuit constituting a control unit is mounted.

Figure 2:
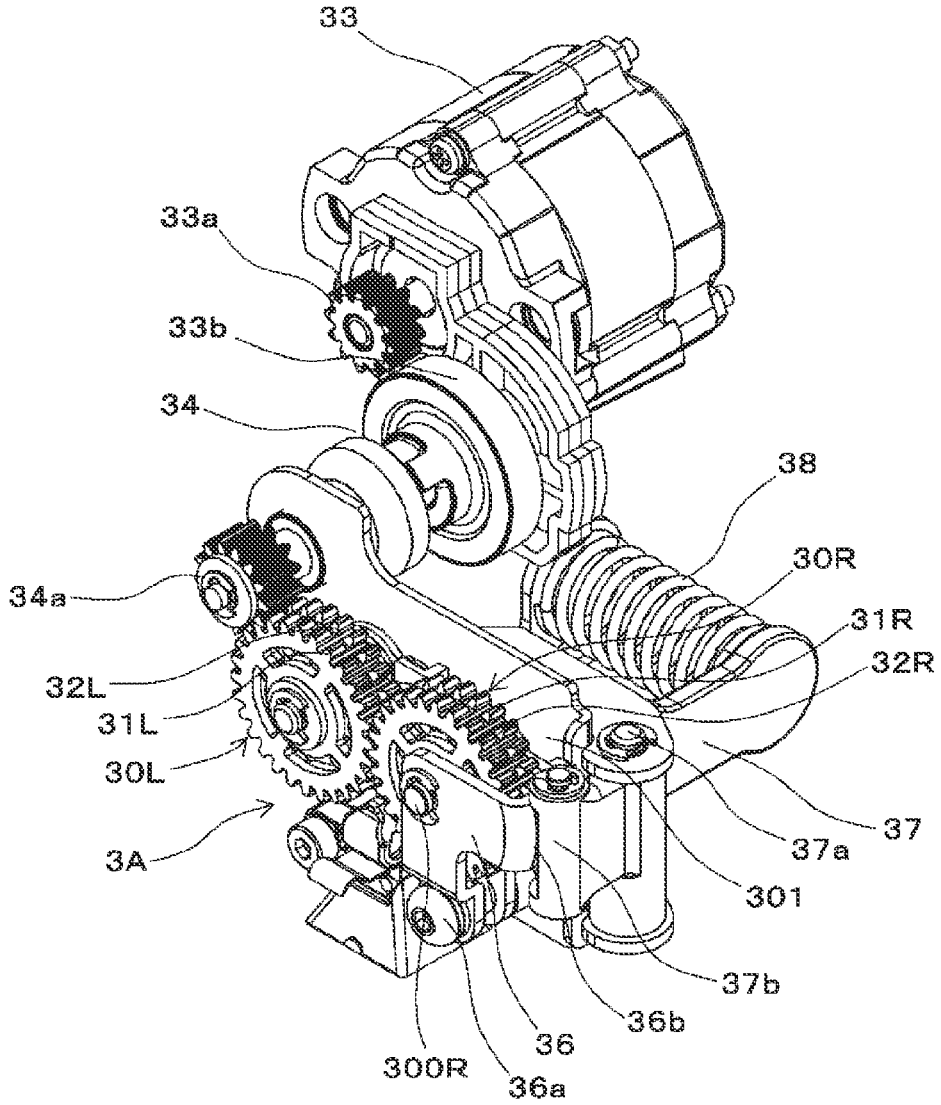
FIG. 2 is a perspective view showing an example of a wire feeding unit.

FIG. 2 is a perspective view showing an example of the wire feeding unit. Subsequently, a configuration of the wire feeding unit 3A is described with reference to the respective drawings.

The first feeding gear 30L, which is one feeding member constituting one of the pair of feeding gears 30, has tooth portions 31L configured to transmit a drive force. In the present example, the tooth portions 31L have a spur gear shape, and are formed over an entire circumference of an outer periphery of the first feeding gear 30L. The first feeding gear 30L also has groove portions 32L in Which the wire W is introduced. In the present example, the groove portions 32L are each constituted by a concave portion whose sectional shape is a substantial V-shape, and are formed along a circumferential direction over the entire circumference of the outer periphery of the first feeding gear 30L.

The second feeding gear 30R, which is the other feeding member constituting the other of the pair of feeding gears 30, has tooth portions 31R configured to transmit a drive force. In the present example, the tooth portions 31R have a spur gear shape, and are formed over an entire circumference of an outer periphery of the second feeding gear 30R. The second feeding gear 30R also has groove portions 32R in which the wire W is introduced. In the present example, the groove portions 32R are each constituted by a concave portion whose sectional shape is a substantial V-shape, and are formed along a circumferential direction over the entire circumference of the outer periphery of the second feeding gear 30R.

In the wire feeding unit 3A, the groove portions 32L of the first feeding gear 30L and the groove portions 32R of the second feeding gear 30R face each other, so that the first feeding gear 30L and the second feeding gear 30R are provided with the feeding path of the wire W being interposed therebetween.

In the wire feeding unit 3A, the tooth portions 31L of the first feeding gear 301 and the tooth portions 31R of the second feeding gear 30R are in mesh with each other in a state where the wire W is sandwiched between the groove portions 32L of the first feeding gear 30L and the groove portions 32R of the second feeding gear 30R. Thereby, the drive force resulting from rotation is transmitted between the first feeding gear 30L and the second feeding gear 30R.

The wire feeding unit 3A includes a feeding motor 33 configured to one of the first feeding gear 30L and the second feeding gear 30R, in the present example, the first feeding gear 30L, and a drive force transmission mechanism 34 configured to transmit a drive force of the feeding motor 33 to the first feeding gear 30L.

The drive force transmission mechanism 34 has a small gear 33*a* attached to a shaft of the feeding motor 33, and a large gear 33*b* in mesh with the small gear 33*a*. The drive force transmission mechanism 34 also has a feeding small gear 34*a* which the drive force is transmitted thereto from the large gear 33*b* and is in mesh with the first feeding gear 30L. The small gear 33*a*, the large gear 33*b* and the feeding small gear 34*a* are each constituted by a spur gear.

The first feeding gear 30L is configured to rotate as a rotating operation of the feeding motor 33 is transmitted thereto via the drive force transmission mechanism 34. The rotating operation of the first feeding gear 30L is transmitted to the second feeding gear 30R by engagement between the tooth portions 31L and the tooth portions 31R, so that the second feeding gear 30R is rotated according to the first feeding gear 30L.

Thereby, the wire feeding unit 3A feeds the wire W sandwiched between the first feeding gear 30L and the second feeding gear 30R along an extension direction of the wire W. In a configuration where the two wires W are fed, the two wires W are fed aligned in parallel by a friction force generated between the groove portions 32L of the first feeding gear 30L and one wire W, a friction force generated between the groove portions 32R of the second feeding gear 30R and the other wire W and a friction force generated between one wire W and the other wire W.

The wire feeding unit 3A is configured so that the rotation directions of the first feeding gear 30L and the second feeding gear 30R are switched and the feeding direction of the wire W is switched between forward and reverse directions by switching the rotation direction of the feeding motor 33 between forward and reverse directions.

The wire feeding unit 3A is configured so that the first feeding gear 30L and the second feeding gear 30R come close to each other to press against each other, so as to sandwich the wire W between the first feeding gear 30L and the second feeding gear 30R. Specifically, the wire feeding unit 3A is configured so that the first feeding gear 30L and the second feeding gear 30R can be displaced in directions of contacting/separating with respect to the other, so as to sandwich the wire W between the first feeding gear 30L and the second feeding gear 30R and to load the wire W between the first feeding gear 30L and the second feeding gear 30R. In the present example, the drive force of the feeding motor 33 is received from the first feeding gear 30L, and the second feeding gear 30R to which the drive force of the feeding motor 33 is not directly transmitted is displaced with respect to the first feeding gear 30L.

Therefore, the wire feeding unit 3A has a first displacement member 36 configured to displace the second feeding gear 30R toward and away from the first feeding gear 30L. The wire feeding unit 3A also has a second displacement member 37 configured to displace the first displacement member 36. The first displacement member 36 and the second displacement member 37 are examples of the displacement part, and are configured to displace one or both of the pair of feeding gears 30 toward and away from each other. In the present example, as described above, the second feeding gear 30R is displaced toward and away from the first feeding gear 30L.

The second feeding gear 30R is rotatably supported on one end portion-side of the first displacement member 36 by a shaft 300R. The other end portion of the first displacement member 36 is rotatable supported to a support member 301 of the wire feeding unit 3A by a shaft 36*a* as a support point.

The shaft 36*a* of the first displacement member 36, which is a support point of the rotating operation, is oriented in parallel to the shaft 300R of the second feeding gear 30R. Thereby, the first displacement member 36 is displaced by a rotating operation about the shaft 36*a* as a support point, thereby causing the second feeding gear 30R to contact/separate with respect to the first feeding gear 30L.

The first displacement member 36 is provided on one end portion-side with a to-be-pressed portion 36*b* that is pressed from the second displacement member 37. The to-be-pressed portion 36*b* is provided on a side of a part at which the shaft 300R of the second feeding gear 30R is supported.

The second displacement member 37 is supported by the support member 301 of the wire feeding unit 3A so as to be rotatable about a shaft 37*a* as a support point. The second displacement member 37 also has a pressing portion 37*b* for pressing against the to-be-pressed portion 36*b* of the first displacement member 36 on one end portion-side that sandwiches the shaft 37*a*.

The second displacement member 37 is displaced by a rotating operation about the shaft 37*a* as a support point, thereby causing the pressing portion 37*b* to press against the to-be-pressed portion 36*b* of the first displacement member 36 and releasing the pressing of the pressing portion 37*b* against the to-be-pressed portion 36*b*.

The wire feeding unit 3A has a spring 38 for pressing the second feeding gear 30R against the first feeding gear 30L. The spring 38 is constituted by a compression coil spring, for example, and presses against the other end portion-side that sandwiches the shaft 37*a* of the second displacement member 37.

The second displacement member 37 is pressed by the spring 38 and is thus displaced by the rotating operation about the shaft 37*a* as a support point, thereby causing the pressing portion 37*b* to press against the to-be-pressed portion 36*b* of the first displacement member 36. When the pressing portion 37*b* of the second displacement member 37 presses against the to-be-pressed portion 36*b* of the first displacement member 36, the first displacement member 36 is displaced by the rotating operation about the shaft 36*a* as a support point. Thereby, the second feeding gear 30R is pressed toward the first feeding gear 30L by the force of the spring 38.

When the wire W is loaded between the first feeding gear 30L and the second feeding gear 30R, the wire W is sandwiched between the groove portions 32L of the first feeding gear 30L and the groove portions 32R of the second feeding gear 30R.

In a state where the wire W is sandwiched between the groove portions 32L of the first feeding gear 30L and the groove portions 32R of the second feeding gear 30R, the tooth portions 31L of the first feeding gear 30L and the tooth portions 31R of the second feeding gear 30R mesh with each other.

Figure 3A:
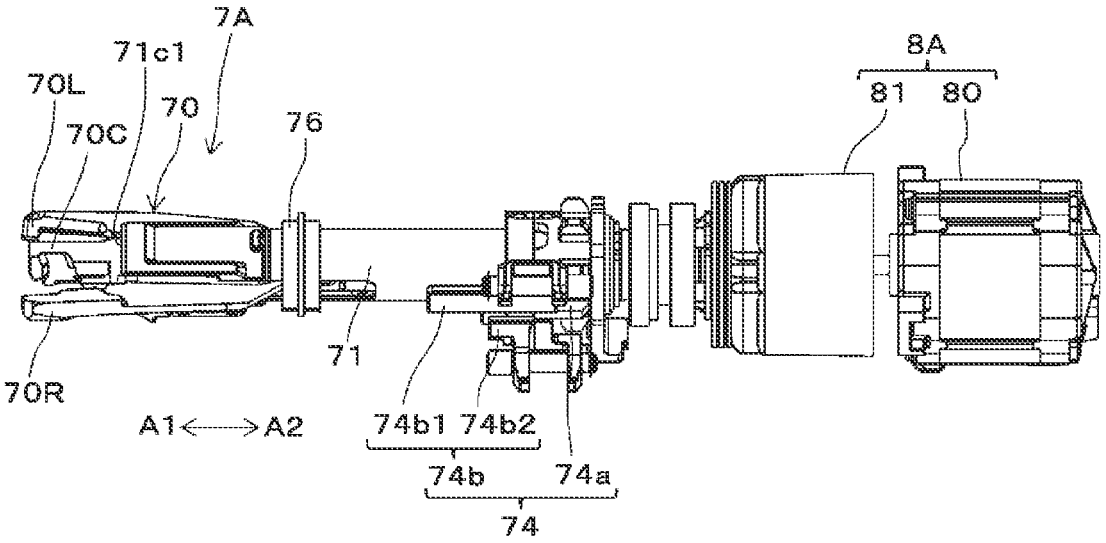
FIG. 3A is a perspective view showing an example of a binding unit.
Figure 3B:
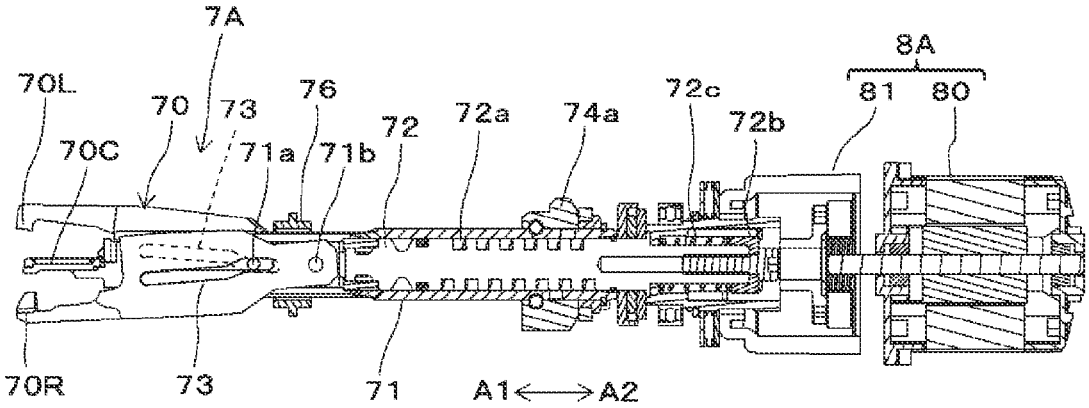
FIG. 3B is a sectional plan view showing the example of the binding unit.
Figure 3C:
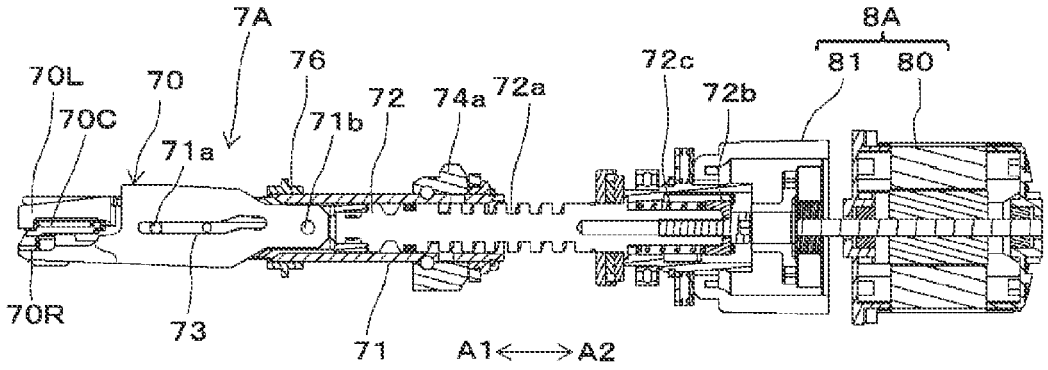
FIG. 3C is a sectional plan view showing the example of the binding unit.

FIG. 3A is a perspective view showing an example of the binding unit, and FIGS. 3B and 3C are sectional plan views showing the example of the binding unit. Subsequently, a configuration of the binding unit is described with reference to the respective drawings.

The binding unit 7A includes a wire engaging body 70 to which the wire W is to be engaged, and a rotary shaft 72 for actuating the wire engaging body 70. The binding unit 7A and the drive unit 8A are configured so that the rotary shaft 72 and the motor 80 are connected each other via the decelerator 81 and the rotary shaft 72 is driven via the decelerator 81 by the motor 80.

The wire engaging body 70 has a center hook 70C connected to the rotary shaft 72, a first side hook 70R and a second side hook 70L configured to open and close with respect to the center hook 70C, and a sleeve 71 configured to actuate the first side hook 70R and the second side hook 70L and to form the wire W into a desired shape.

In the binding unit 7A, a side on which the center hook 70C, the first side hook 70R and the second side hook 70L are provided is referred to as a front side, and a side on which the rotary shaft 72 is connected to the decelerator 81 is referred to as a rear side.

The center hook 70C is connected to a front end of the rotary shaft 72, which is one end portion, via a configuration that can rotate with respect to the rotary shaft 72 and move integrally with the rotary shaft 72 in an axis direction.

A tip end-side of the first side hook 70R, which is one end portion in the axis direction of the rotary shaft 72, is positioned at one side part with respect to the center hook 70C. A rear end-side of the first side hook 70R, which is the other end portion in the axis direction of the rotary shaft 72, is rotatably supported to the center hook 70C by a shaft 71*b*.

A tip end-side of the second side hook 70L, which is one end portion in the axis direction of the rotary shaft 72, is positioned at the other side part with respect to the center hook 70C. A rear end-side of the second side hook 70L, which is the other end portion in the axis direction of the rotary shaft 72, is rotatably supported to the center hook 70C by the shaft 71*b*.

Thereby, the wire engaging body 70 opens/closes in directions in which the tip end-side of the first side hook 70R separates and contacts with respect to the center hook 70C by a rotating operation about the shaft 71*b* as a support point. The wire engaging body 70 also opens/closes in directions in which the tip end-side of the second side hook 701 separates and contacts with respect to the center hook 70C.

A rear end of the rotary shaft 72, which is the other end portion, is connected to the decelerator 81 via a connection portion 72*b* having a configuration that can cause the connection portion to rotate integrally with the decelerator 81 and to move in the axis direction with respect to the decelerator 81. The connection portion 72*b* has a spring 72*c* for urging backward the rotary shaft 72 toward the decelerator 81. In this way, the rotary shaft 72 is configured to be movable forward away from the decelerator 81 while receiving a force pulled backward by the spring 72*c*.

The sleeve 71 is supported to be rotatable and to be axially slidable by a support frame 76. The support frame 76 is an annular member and is attached to the main body part 10A in a form in which it cannot rotate circumferentially and move axially.

The sleeve 71 has a convex portion (not shown) protruding from an inner peripheral surface of a space in which the rotary shaft 72 is inserted, and the convex portion enters a groove portion of a feeding screw 72*a* formed along the axis direction on an outer periphery of the rotary shaft 72. When the rotary shaft 72 rotates, the sleeve 71 moves in a front and rear direction along the axis direction of the rotary shaft 72 according to a rotation direction of the rotary shaft 72 by an action of the convex portion (not shown) and the feeding screw 72*a* of the rotary shaft 72. The sleeve 71 also rotates integrally with the rotary shaft 72.

The sleeve 71 has an opening/closing pin 71*a* configured to open/close the first side hook 70R and the second side hook 70L.

The opening/closing pin 71*a* is inserted into opening/closing guide holes 73 formed in the first side hook 70R and the second side hook 70L. The opening/closing guide hole 73 has a shape of extending in a moving direction of the sleeve 71 and converting linear motion of the opening/closing pin 71*a* configured to move in conjunction with the sleeve 71 into an opening/closing operation by rotation of the first side hook 70R and the second side hook 70L about the shaft 71*b* as a support point.

The wire engaging body 70 is configured so that, when the sleeve 71 is moved backward (refer to an arrow A2), the first side hook 70R and the second side hook 70L move away from the center hook 70C by the rotating operations about the shaft 71*b* as a support point, due to a locus of the opening/closing pin 71*a* and the shape of the opening/closing guide holes 73.

Thereby, the first side hook 70R and the second side hook 70L are opened with respect to the center hook 70C, so that a feeding path through which the wire W is to pass is formed between the first side hook 70R and the center hook 70C and between the second side hook 70L and the center hook 70C.

In a state where the first side hook 70R and the second side hook 70L are opened with respect to the center hook 70C, the wire W that is fed by the wire feeding unit 3A passes between the center hook 70C and the first side hook 70R. The wire W passing between the center hook 70C and the first side hook 70R is guided to the curl forming unit 5A. Then, the wire curled by the curl forming unit 5A and guided to the binding unit 7A passes between the center hook 70C and the second side hook 70L.

The wire engaging body 70 is configured so that, when the sleeve 71 is moved in the forward direction denoted with an arrow A1, the first side hook 70R and the second side hook 70L move toward the center hook 70C by the rotating operations about the shaft 76 as a support point, due to the locus of the opening/closing pin 71*a* and the shape of the opening/closing guide holes 73. Thereby, the first side hook 70R and the second side hook 701, are closed with respect to the center hook 70C.

When the first side hook 70R is closed with respect to the center hook 70C, the wire W sandwiched between the first side hook 70R and the center hook 70C is engaged in such an aspect that the wire can move between the first side hook 70R and the center hook 70C. Also, when the second side hook 70L is closed with respect to the center hook 70C, the wire W sandwiched between the second side hook 70L and the center hook 70C is engaged in such an aspect that the wire cannot come off from between the second side hook 70L and the center hook 70C.

The sleeve 71 has a bending portion 71*c*1 configured to push and bend a tip end-side (one end portion) of the wire W in a predetermined direction to form the wire W into a predetermined shape, and a bending portion 71*c*2 configured to push and bend a terminal end-side (the other end portion) of the wire W cut by the cutting unit 6A in a predetermined direction to form the wire W into a predetermined shape.

The sleeve 71 is moved in the forward direction denoted with the arrow A1, so that the tip end-side of the wire W engaged by the center hook 70C and the second side hook 70L is pushed and is bent toward the reinforcing bars S by the bending portion 71*a* Also, the sleeve 71 is moved in the forward direction denoted with the arrow A1, so that the terminal end-side of the wire W engaged by the center hook 70C and the first side hook 70R and cut by the cutting unit 6A is pushed and bent toward the reinforcing bars S by the bending portion 71*c*2.

The binding unit 7A includes a rotation regulation part 74 configured to regulate rotations of the wire engaging body 70 and the sleeve 71 in conjunction with the rotating operation of the rotary shaft 72. The rotation regulation part 74 has a rotation regulation blade 74*a* provided to the sleeve 71 and a rotation regulation claw 74*b* provided to the main body part 10A.

The rotation regulation blade 74*a* is constituted by a plurality of convex portions protruding diametrically from an outer periphery of the sleeve 71 and provided at predetermined intervals in a circumferential direction of the sleeve 71. The rotation regulation blade 74*a* is fixed to the sleeve 71 and is moved and rotated integrally with the sleeve 71.

The rotation regulation claw 74*b* has a first claw portion 74*b*1 and a second claw portion 74*b*2, as a pair of claw portions facing each other at an interval through which the rotation regulation blade 74*a* can pass. The first claw portion 74*b*1 and the second claw portion 74*b*2 are configured to be retractable from the locus of the rotation regulation blade 74*a* by being pushed by the rotation regulation blade 74*a* according to the rotation direction of the rotation regulation blade 74*a*.

When the rotation regulation blade 74*a* of the rotation regulation part 74 is engaged to the rotation regulation claw 74*b*, the rotation of the sleeve 71 in conjunction with the rotation of the rotary shaft 72 is regulated, so that the sleeve 71 is moved in the front and rear direction by the rotating operation of the rotary shaft 72. Also, when the rotation regulation blade 74*a* is disengaged from the rotation regulation claw 74*b*, the sleeve 71 is rotated in conjunction with the rotation of the rotary shaft 72.

Figure 4:
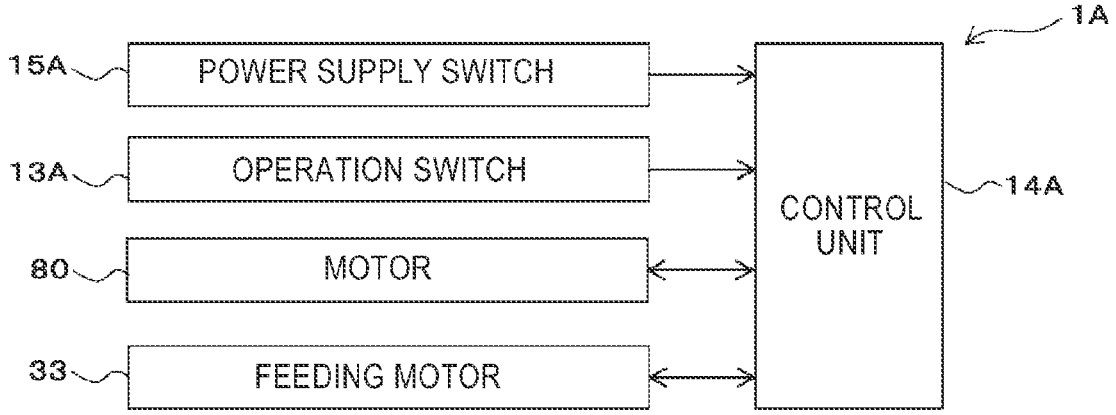
FIG. 4 is a block diagram showing an example of a control function of the reinforcing bar binding machine.

FIG. 4 is a block diagram showing an example of a control function of the reinforcing bar binding machine. In the reinforcing bar binding machine 1A, the control unit 14A is configured to control the motor 80 and the feeding motor 31 and to execute a series of operations of binding the reinforcing bars S with the wire W, according to a state of the switch 13A that is pushed by an operation on the trigger 12A shown in FIG. 1. The control unit HA is also configured to switch on and off states of a power supply, according to an operation on a power supply switch 15A. The control unit 14A is also configured to control the feeding motor 33 and to perform loading and discharging of the wire W in the wire feeding unit 3A, based on a combination of operations on the operation switch 13A and the power supply switch 15A and the like.

<Example of Operation of Reinforcing Bar Binding Machine>

The operations of binding the reinforcing bars S with the wire W by the reinforcing bar binding machine 1A are described with reference to the respective drawings.

The reinforcing bar binding machine 1A is in a standby state (standby position) where the wire W is sandwiched between the first feeding gear 30L and the second feeding gear 30R and the tip end of the wire W is positioned between the sandwiched position by the pair of feeding gears 30 and the fixed blade part 60 of the cutting unit 6A. Also, as shown in FIGS. 3A and 3B, when the reinforcing bar binding machine 1A is in the standby state, the first side hook 70R is opened with respect to the center hook 70C and the second side hook 70L is opened with respect to the center hook 70C.

When the reinforcing bars S are inserted between the curl guide 50 and the induction guide 51A of the curl forming unit 5A and the trigger 12A is operated, the control unit 14A drives the feeding motor 31 in the forward rotation direction, thereby feeding the wire W in the forward direction denoted with the arrow F, which is a first direction, by the wire feeding unit 3A.

In a configuration where a plurality of, for example, two wires W are fed, the two wires W are fed aligned in parallel along an axis direction of the loop Ru, which is formed by the wires W, by a wire guide (not shown).

The wire W fed in the forward direction passes between the center hook 70C and the first side hook 70R and is then fed to the curl guide 50 of the curl forming unit 5A. The wire W passes through the curl guide 50, so that it is curled to be wound around the reinforcing bars S.

The wire W curled by the curl guide 50 is guided to the induction guide 51 and is further fed in the forward direction by the wire feeding unit 3A, so that the wire is guided between the center hook 70C and the second side hook 70L by the induction guide 51. The wire W is fed until the tip end is butted against the feeding regulation part 90. When the wire W is fed to a position in which the tip end is butted against the feeding regulation part 90, the control unit 14A stops the drive of the feeding motor 31.

After stopping the feeding of the wire W in the forward direction, the control unit 14A drives the motor 80 in the forward rotation direction. In the operation area where the wire W is engaged by the wire engaging body 70, the rotation regulation blade 74*a* is engaged to the rotation regulation claw 74*b*, so that the rotation of the sleeve 71 in conjunction with the rotation of the rotary shaft 72 is regulated. Thereby, the rotation of the motor 80 is converted into linear movement, so that the sleeve 71 is moved in the forward direction denoted with the arrow A1.

When the sleeve 71 is moved in the forward direction, the opening/closing pin 71*a* passes through the opening/closing guide holes 73. Thereby, the first side hook 70R is moved toward the center hook 70C by the rotating operation about the shaft 71*b* as a support point. When the first side hook 70R is closed with respect to the center hook 70C, the wire W sandwiched between the first side hook 70R and the center hook 70C is engaged in such an aspect that the wire can move between the first side hook 70R and the center hook 70C.

Also, the second side hook 70L is moved toward the center hook 70C by the rotating operation about the shaft 71*b* as a support point. When the second side hook 70L is closed with respect to the center hook 70C, the wire W sandwiched between the second side hook 70L and the center hook 70C is engaged is in such an aspect that the wire cannot come off from between the second side hook 70L and the center hook 70C.

After advancing the sleeve 71 to a position in which the wire W is engaged by the closing operation of the first side hook 70R and the second side hook 70L, the control unit 14A temporarily stops the rotation of the motor 80 and drives the feeding motor 31 in the reverse rotation direction. Thereby, the pair of feeding gears 30 is driven in the reverse rotation direction.

Therefore, the wire W sandwiched between the pair of feeding gears 30 is fed in the reverse direction denoted with the arrow R, which is a second direction. Since the tip end-side of the wire W is engaged in such an aspect that the wire cannot come off from between the second side hook 70L and the center hook 70C, the wire W is wound on the reinforcing bars S by the operation of feeding the wire W in the reverse direction.

When the wire W is pulled back to a position in which the wire is wound on the reinforcing bars S, the control unit 14A stops the drive of the feeding motor 31 in the reverse rotation direction and then drives the motor 80 in the forward rotation direction, thereby moving the sleeve 71 in the forward direction denoted with the arrow A1. The operation of moving the sleeve 71 in the forward direction is transmitted to the cutting unit 6A by the transmission mechanism 62, so that the movable blade part 61 is rotated and the wire W engaged by the first side hook 70R, and the center hook 70C is cut by the operation of the fixed blade part 60 and the movable blade part 61.

The bending portions 71*c*1 and 71*c*2 are moved toward the reinforcing bars S substantially at the same time when the wire w is cut. Thereby, the tip end-side of the wire W engaged by the center hook 70C and the second side hook 70E is pressed toward the reinforcing bars S and bent toward the reinforcing bars S at the engaging position as a support point by the bending portion 71*c*1. The sleeve 71 is further moved in the forward direction, so that the wire W engaged between the second side hook 70L and the center hook 70C is maintained sandwiched by the bending portion 71*c*1.

Also, the terminal end-side of the wire W engaged by the center hook 70C and the first side hook 70R and cut by the cutting unit 6A is pressed toward the reinforcing bars S and bent toward the reinforcing bars S at the engaging position as a support point by the bending portion 71*c*2. The sleeve 71 is further moved in the forward direction, so that the wire W engaged between the first side hook 70R and the center hook 70C is maintained sandwiched by the bending portion 71*c*2.

After the tip end-side and the terminal end-side of the wire W are bent toward the reinforcing bars S, the motor 80 is further driven in the forward rotation direction, so that the sleeve 71 is further moved in the forward direction. When the sleeve 71 is moved to a predetermined position and reaches the operation area where the wire W engaged by the wire engaging body 70 is twisted, the engaging of the rotation regulation blade 74*a* with the rotation regulation claw 74*b* is released.

Thereby, the motor 80 is further driven in the forward rotation direction, so that the wire engaging body 70 is rotated in conjunction with the rotary shaft 72, thereby twisting the wire W.

In the binding unit 7A, in the operation area where the sleeve 71 rotates, the reinforcing bars S are butted against the butting part 91, so that the backward movement of the reinforcing bars S toward the binding unit 7A is regulated. Therefore, the wire W is twisted, so that a force of pulling the wire engaging body 70 forward along the axis direction of the rotary shaft 72 is applied.

When the force of moving the wire engaging body 70 forward along the axis direction of the rotary shaft 72 is applied to the wire engaging body 70, the rotary shaft 72 can move forward while receiving a force pushed backward by the spring 72*c*. Thereby, in the binding unit 7A, in the operation area where the sleeve 71 rotates, the wire engaging body 70 and the rotary shaft 72 twist the wire W while moving forward.

FIGS. 5, 6A, 6B and 6C are flowcharts showing examples of loading and discharging the wire in the reinforcing bar binding machine. Subsequently, the operations of loading and discharging the wire in the reinforcing bar binding machine 1A are described.

In the present example of the reinforcing bar binding machine 1A, a combination of a predetermined operation on the trigger 12A and a predetermined operation on the power supply switch 15A is allotted to executions of automatic loading and automatic discharge of the wire W. In examples below it is assumed that when the power supply switch 15A is operated while operating the trigger 12A, automatic loading and automatic discharge are started.

Figure 5:
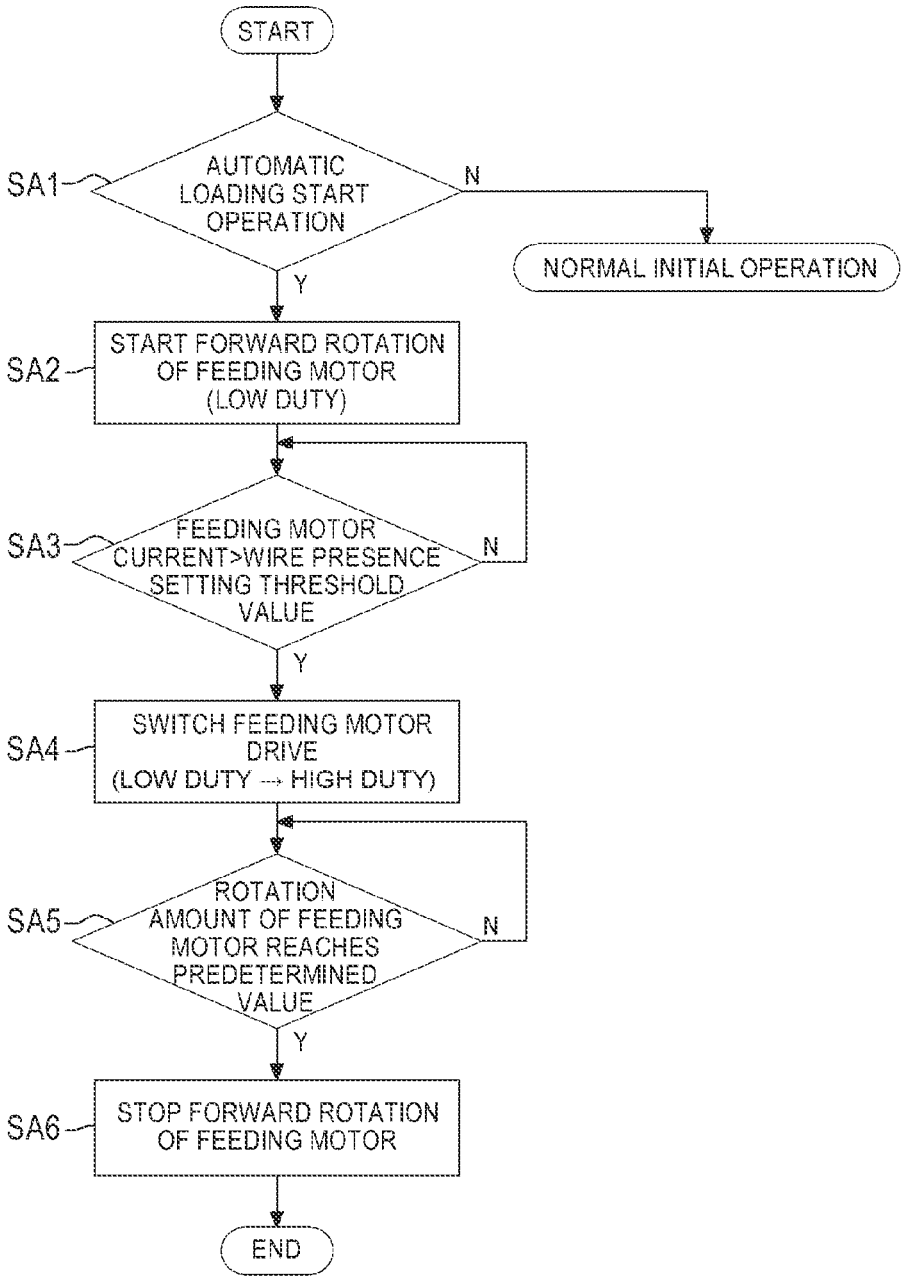
FIG. 5 is a flowchart showing an example of operations of loading and discharging a wire in the reinforcing bar binding machine.

First, an automatic loading operation shown in FIG. 5 is described. In step SA1 of FIG. 5, the control unit 14A determines whether a predetermined automatic loading start operation has been performed, according to an operation on the power supply switch 15A. When it is determined that the predetermined automatic loading start operation has been performed, the control unit 14A drives the feeding motor 33 in the forward rotation direction with a duty ratio (low duty) at which the rotating speed of the feeding motor 33 becomes a first speed, in step SA2. On the other hand, when it is determined in step SA1 that a normal operation of turning on a power supply has been performed, the control unit 14A executes normal initial processing.

The user of the reinforcing bar binding machine 1A inserts the reel 20 into the magazine 2A, and guides the tip end of the wire W reeled out from the reel 20 between the first feeding gear 30L and the second feeding gear 30R of the wire feeding unit 3A. When the tip end of the wire W reeled out from the reel 20 is sandwiched between the first feeding gear 30L and the second feeding gear 30R, the wire W is fed in the forward direction, a load applied to the feeding motor 33 increases, and a value of current flowing through the feeding motor 33 increases.

In step SA3 of FIG. 5, the control unit 14A compares the value of current flowing through the feeding motor 33 and a predetermined setting threshold value for detecting that there is the wire W, and determines whether the wire W is sandwiched between the first feeding gear 30L and the second feeding gear 30R. When it is determined that the wire W is sandwiched between the first feeding gear 30L and the second feeding gear 30R, the control unit 14A switches the duty ratio to a duty ratio (high duty) at which the rotating speed of the feeding motor 33 becomes a second speed higher than the first speed, and further drives the feeding motor 33 in the forward rotation direction, in step SA4.

In step SA5 of FIG. 5, the control unit 14A determines whether the feeding amount of the wire W becomes a predetermined amount by which the wire is fed to the standby position, for example, from the rotating amount of the feeding motor 33, and the like. When it is determined that the feeding amount of the wire W becomes a predetermined amount, the control unit 14A stops the drive of the feeding motor 33, in step SA6.

Note that, after stopping the feeding of the wire W in the forward direction by stopping the drive of the feeding motor 33, a so-called initializing operation of positioning a position of the tip end of the wire W to a predetermined position may be performed.

Specifically, in step SA5 of FIG. 5, it is determined whether the tip end of the wire W fed in the forward direction passes through the cutting unit 6A and is fed to a position in which the wire W can be cut by the movable blade part 61, from the rotating amount of the feeding motor 33, and the like. When it is determined that the feeding amount of the wire W becomes a predetermined amount and the tip end of the wire W is fed to a position in which the wire W can be cut by the movable blade part 61, the control unit 14A stops the drive of the feeding motor 33, in step SA6.

Then, the control unit 14A drives the motor 80 in the forward rotation direction to move the sleeve 71 in the forward direction denoted with the arrow A1, thereby rotating the movable blade part 61 to cut the wire W. Then, the control unit 14A drives the motor 80 in the reverse rotation direction to move the sleeve 71 in the backward direction denoted with the arrow A2, thereby setting the binding unit 7A to the standby state. Thereby, the wire W is sandwiched between the first feeding gear 30L and the second feeding gear 30R, and the tip end of the wire W is in the standby position between the sandwiched position by the pair of feeding gears 30 and the fixed blade part 60 of the cutting unit 6A.

Figure 6A:
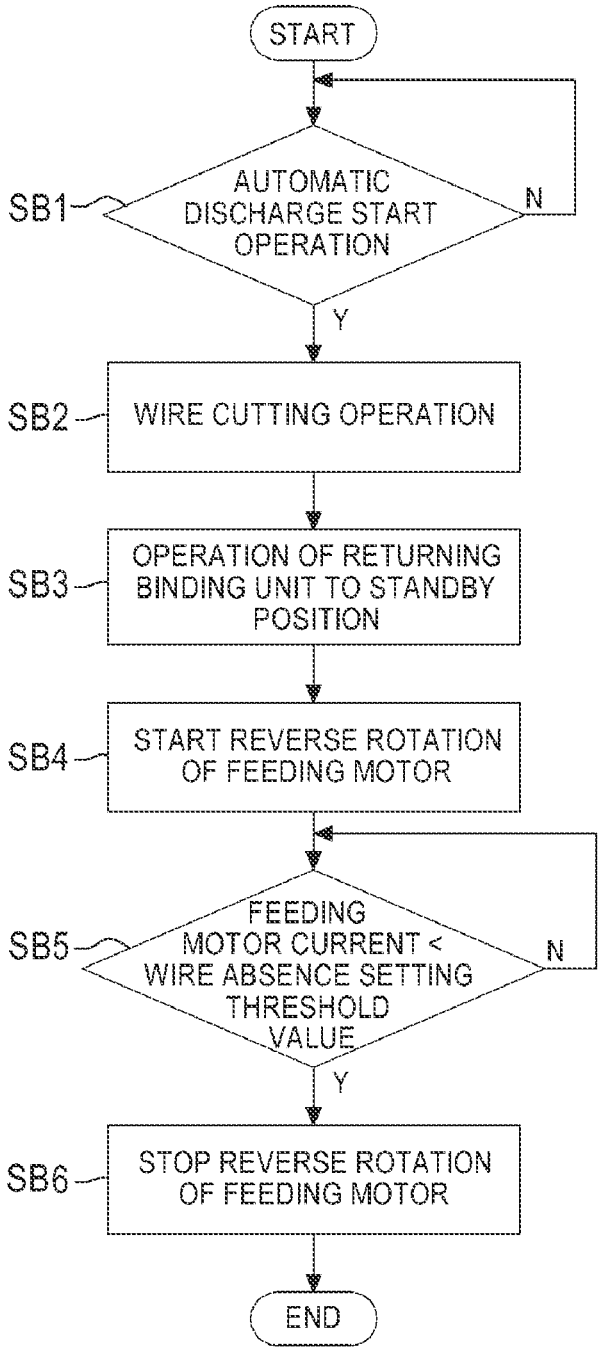
FIG. 6A is a flowchart showing an example of operations of loading and discharging a wire in the reinforcing bar binding machine.

Subsequently, an automatic discharge operation shown in FIG. 6A is described. In step SB1 of FIG. 6A, the control unit 14A determines whether the predetermined automatic discharge start operation has been performed, according to an operation on the power supply switch 15A. When it is determined that the predetermined automatic discharge start operation has been performed, the control unit 14A drives the motor 80 in the forward rotation direction to move the sleeve 71 in the forward direction denoted with the arrow A1, thereby executing a wire cutting operation of rotating the movable blade part 61, in step SB2. In a case where the wire W is in a position in which the wire can be cut by the movable blade part 61, the wire W is cut and separated into a wire W positioned closer to the binding unit 7A than the cutting unit 6A and a wire W positioned closer to the wire feeding unit 3A than the cutting unit 6A. When the motor 80 is driven in the forward rotation direction by a predetermined amount, the control unit 14A drives the motor 80 in the reverse rotation direction to move the sleeve 71 in the backward direction denoted with the arrow A2, thereby returning the binding unit 7A to the standby state, in step SB3. When the control unit 14A performs the operation of rotating the movable blade part 61 and the operation of returning the binding unit 7A to the standby state, the control unit 14A drives the feeding motor 33 in the reverse rotation direction, in step SB4. Note that, in the automatic discharge operation, the operation of rotating the movable blade part 61 in step SB2 and the operation of returning the binding unit 7A to the standby state in step SB3 may not be performed.

When the feeding motor 33 is driven in the reverse rotation direction to feed the wire W in the reverse direction and the tip end of the wire W sandwiched between the first feeding gear 30L and the second feeding gear 30R comes off from between the first feeding gear 30L and the second feeding gear 30R, the load applied to the feeding motor 33 decreases and the value of current flowing through the feeding motor 33 decreases.

In step SB5 of FIG. 6A, the control unit 14A compares the value of current flowing through the feeding motor 33 and a predetermined setting threshold value for detecting that there is no wire W between the first feeding gear 30L and the second feeding gear 30R, and determines whether the wire W comes off from between the first feeding gear 30L and the second feeding gear 30R. When it is determined that the wire W comes off from between the first feeding gear 30L and the second feeding gear 30R, the control unit 14A stops the drive of the feeding motor 33, in step SB6.

Although it has been described that the automatic discharge operation shown in FIG. 6A is executed by the predetermined automatic discharge start operation, it may also be determined whether to start the automatic discharge, from a state of the wire W wound on the reel 20, i.e., a remaining amount of the wire W.

For example, when the wire W wound on the reel 20 is exhausted during the operation of feeding the wire W in the forward direction so as to wind the wire W V around the reinforcing bars S, the wire W may not be reeled out from the reel 20. In this case, the load applied to the feeding motor 33 increases and the value of current flowing through the feeding motor 33 increases.

Figure 6B:
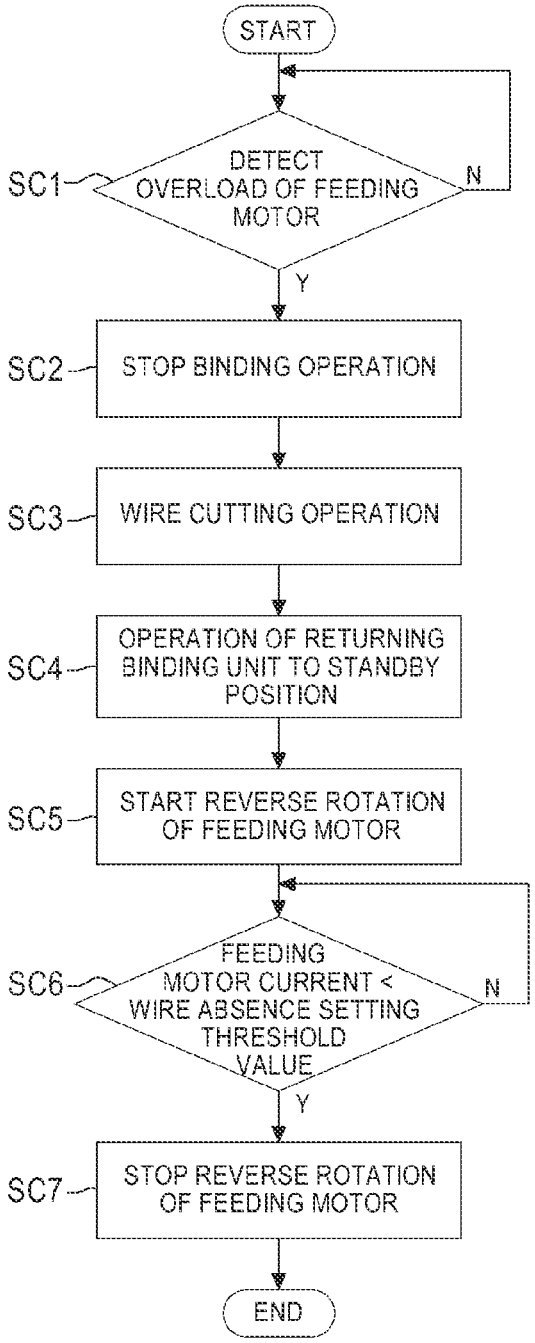
FIG. 6B is a flowchart showing an example of operations of loading and discharging a wire in the reinforcing bar binding machine.

Therefore, in step SC1 of FIG. 6B, while executing the normal binding operation and the like and driving the feeding motor 33 in the forward rotation direction, the control unit 14A compares the value of current flowing through the feeding motor 33 and a predetermined setting threshold value for detecting that the wire W is exhausted. The control unit 14A detects whether the feeding motor 33 is in a predetermined overload state, and determines whether the wire W is exhausted from the reel 20. When it is determined that the wire W is exhausted from the reel 20, the control unit 14A stops the binding operation of driving the feeding motor 33 in the forward rotation direction, and the like, and executes the automatic discharge operation, in step SC2.

Specifically, in step SC3, the control unit 14A drives the motor 80 in the forward rotation direction to move the sleeve 71 in the forward direction denoted with the arrow A1, thereby rotating the movable blade part 61. When the wire W is in a position in which it can be cut by the movable blade part 61, the wire W is cut. When the control unit 14A drives the motor 80 in the forward rotation direction by a predetermined amount, the control unit I4A drives the motor 80 in the reverse rotation direction to move the sleeve 71 in the backward direction denoted with the arrow A2, thereby setting the binding unit 7A to the standby state, in step SC4. When the control unit 14A performs the operation of rotating the movable blade part 61 and the operation of returning the binding unit 7A to the standby state, the control unit 14A drives the feeding motor 33 in the reverse rotation direction, in step SC5. Note that, also in the automatic discharge operation, the operation of rotating the movable blade part 61 in step SC3 and the operation of returning the binding unit 7A to the standby state in step SC4 may not be performed.

In step SC6 of FIG. 6B, the control unit 14A compares the value of current flowing through the feeding motor 33 and the predetermined setting threshold value for detecting that there is no wire W between the first feeding gear 30L and the second feeding gear 30R, and determines whether the wire W comes off from between the first feeding gear 30L and the second feeding gear 30R. When it is determined that the wire W comes off from between the first feeding gear 30L and the second feeding gear 30R, the control unit 14A stops the drive of the feeding motor 33, in step SC7. Note that, in the processing of detecting that the wire W is exhausted from the reel 20 and performing the automatic discharge operation, the control unit may notify that the wire W is exhausted, before starting the automatic discharge operation.

Figure 6C:
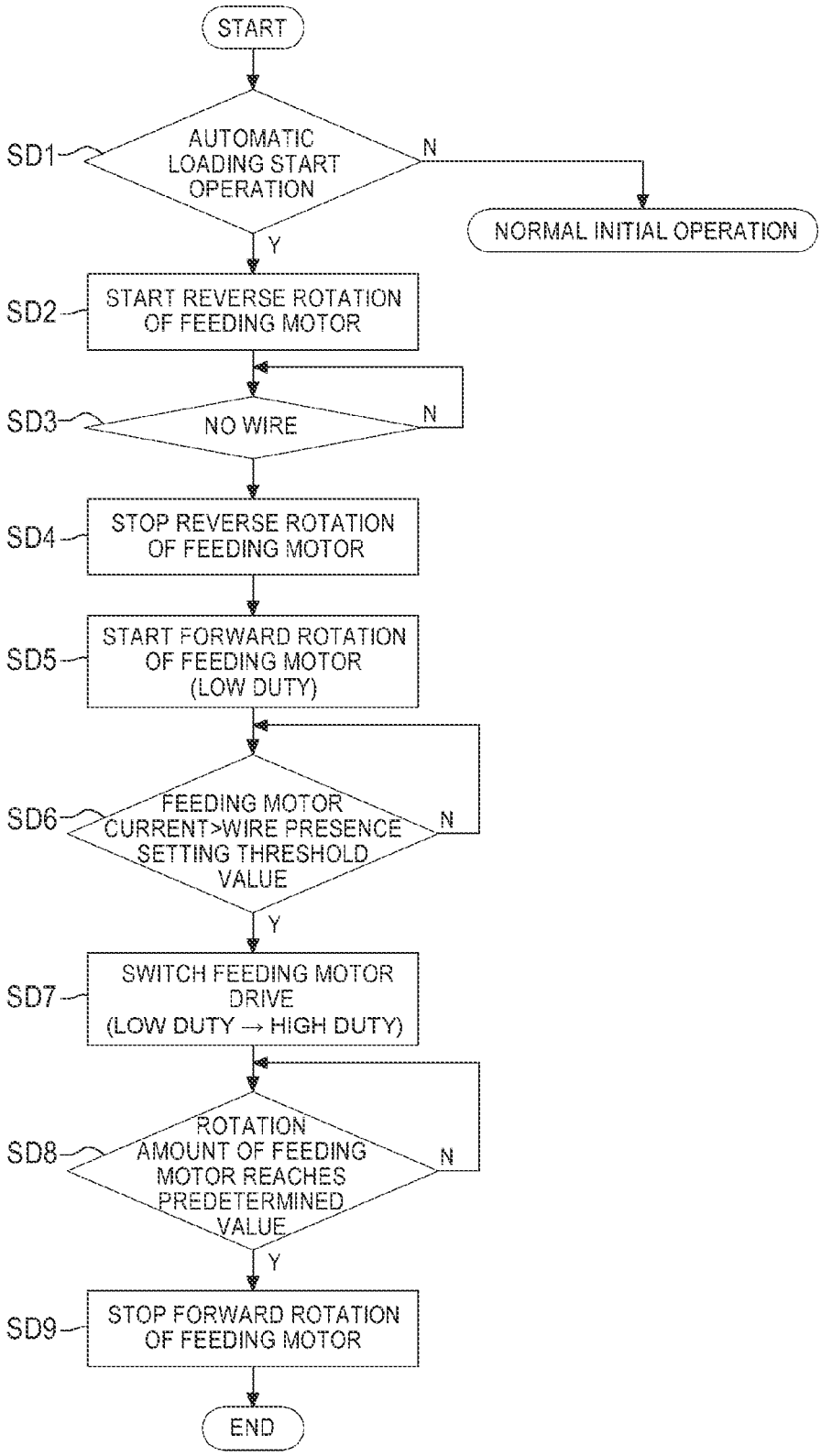
FIG. 6C is a flowchart showing an example of operations of loading and discharging a wire in the reinforcing bar binding machine.

Note that, as shown in FIG. 6C, before performing the automatic loading operation, the automatic discharge operation may be performed so as to exclude a state in which the wire W is sandwiched between the pair of feeding gears 30, and then the automatic loading operation may be stated.

In step SD1 of FIG. 6C, the control unit 14A determines whether the predetermined automatic loading start operation has been performed. When it is determined that the predetermined automatic loading start operation has been performed, the control unit 14A drives the feeding motor 33 in the reverse rotation direction, in step SD2. Note that, in the automatic discharge operation that is executed before the automatic loading operation, the operation of rotating the movable blade part 61 and the operation of returning the binding unit 7A to the standby state may be performed before driving the feeding motor 33 in the reverse rotation direction.

After starting the automatic discharge operation, the control unit 14A determines whether there is the wire W between the pair of feeding gears 30, in step SD3 of FIG. 6C. For example, when the load applied to the feeding motor 33 does not vary for a predetermined time and the value of current flowing through the feeding motor 33 does not change, the control unit 14A determines that the wire W is not sandwiched between the pair of feeding gears 30, and stops the drive of the feeding motor 33 in the reverse rotation direction and starts the automatic loading operation, in step SD4. When the load applied to the feeding motor 33 decreases and the value of current flowing through the feeding motor 33 decreases after the automatic discharge operation is started, the control unit 14A determines that the wire W comes off from between the pair of feeding gears 30, and stops the drive of the feeding motor 33 in the reverse rotation direction and starts the automatic loading operation, in step SD4.

The automatic loading operation after the automatic discharge operation is equivalent to the automatic loading operation described in FIG. 5, and the control unit 14A drives the feeding motor 33 in the forward rotation direction with the duty ratio (low duty) at which the rotating speed of the feeding motor 33 becomes the first speed, in step SD5.

The user of the reinforcing bar binding machine 1A inserts the reel 20 into the magazine 2A, and guides the tip end of the wire W reeled out from the reel 20 between the first feeding gear 30L and the second feeding gear 30R of the wire feeding unit 3A. When the tip end of the wire W reeled out from the reel 20 is sandwiched between the first feeding gear 30L and the second feeding gear 30R, the wire W is fed in the forward direction, the load applied to the feeding motor 33 increases, and the value of current flowing through the feeding motor 33 increases.

In step SD6 of FIG. 6C, the control unit 14A compares the value of current flowing through the feeding motor 33 and the predetermined setting threshold value for detecting that there is the wire W, and determines whether the wire W is sandwiched between the first feeding gear 30L and the second feeding gear 30R. When it is determined that the wire W is sandwiched between the first feeding gear 30L and the second feeding gear 30R, the control unit 14A switches the duty ratio to the duty ratio (high duty) at which the rotating speed of the feeding motor 33 becomes the second speed higher than the first speed, and further drives the feeding motor 33 in the forward rotation direction, in step SD7.

In step SD8 of FIG. 6C, the control unit 14A determines whether the feeding amount of the wire W becomes a predetermined amount by which the wire is fed to the predetermined standby position, from the rotating amount of the feeding motor 33, and the like. When it is determined that the feeding amount of the wire W becomes the predetermined amount, the control unit I4A stops the drive of the feeding motor 33, in step SD9.

Note that, after stopping the feeding of the wire W in the forward direction by stopping the drive of the feeding motor 33, a so-called initializing operation of positioning a position of the tip end of the wire W to a predetermined position may be performed.

In the automatic loading and automatic discharge, the automatic loading and automatic discharge are enabled without a sensor configured to detect the wire W. However, a sensor configured to detect the wire W may be provided.

For example, during the operation of feeding the wire W in the forward direction so as to wind the wire W around the reinforcing bars 5, when the wire W wound on the reel 20 is exhausted, a rear end of the wire W may come off from the reel 20. In this case, when a sensor configured to detect the wire W is provided on the feeding path of the wire W between the wire feeding unit 3A and the magazine 2A, the rear end of the wire W can be detected.

Therefore, while driving the feeding motor 33 in the forward rotation direction in the normal binding operation and the like, when the sensor (not shown) detects the rear end of the wire W, the control unit 14A determines that the wire W is exhausted from the reel 20, and executes the automatic discharge operation from step SC2.

In addition, by detecting the tip end of the wire W with a sensor (not shown) provided on the feeding path of the wire W between the wire feeding unit 3A and the magazine 2A, the automatic loading operation may be executed while replacing the automatic loading start operation with the detection of the wire W by the sensor.

Further, by detecting the tip end of the wire W with the sensor (not shown) provided on the feeding path of the wire W between the wire feeding unit 3A and the magazine 2A or the sensor (not shown) provided on the feeding path of the wire W between the wire feeding unit 3A and the cutting unit 6A, it is possible to detect that the wire W is fed to the predetermined position in the automatic loading operation, and to end the automatic loading operation.

Figure 7:
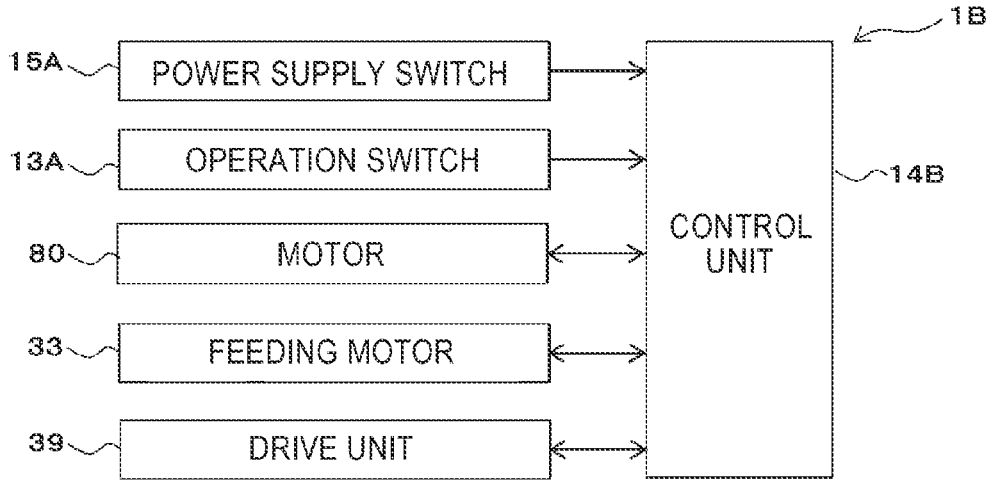
FIG. 7 is a block diagram showing an example of a control function of a reinforcing bar binding machine of another embodiment.

FIG. 7 is a block diagram showing an example of a control function of a reinforcing bar binding machine according to another embodiment. A reinforcing bar binding machine 1B includes a drive unit 39 configured to displace the second displacement member 37 described in FIG. 2. The drive unit 39 is constituted by a motor, a solenoid, a drive force transmission mechanism and the like, and is configured to displace one or both of the pair of feeding gears 30 toward or away from each other. In the present example, the second feeding gear 30R is displaced toward and away from the first feeding gear 30L. Note that, the drive unit 39 may also be configured to directly displace the first displacement member 36.

A control unit 14B is configured to control the motor 80 and the feeding motor 33 and to execute a series of operations of binding the reinforcing bars S with the wire W, according to a state of the switch 13A that is pushed by an operation on the trigger 12A shown in FIG. 1. The control unit 14B is also configured to switch on and off states of a power supply, according to an operation on the power supply switch 15A. The control unit 14B is also configured to control the drive unit 39 and to perform loading and discharging of the wire W, based on a combination of operations on the operation switch 13A and the power supply switch 15A, and the like.

Figure 8A:
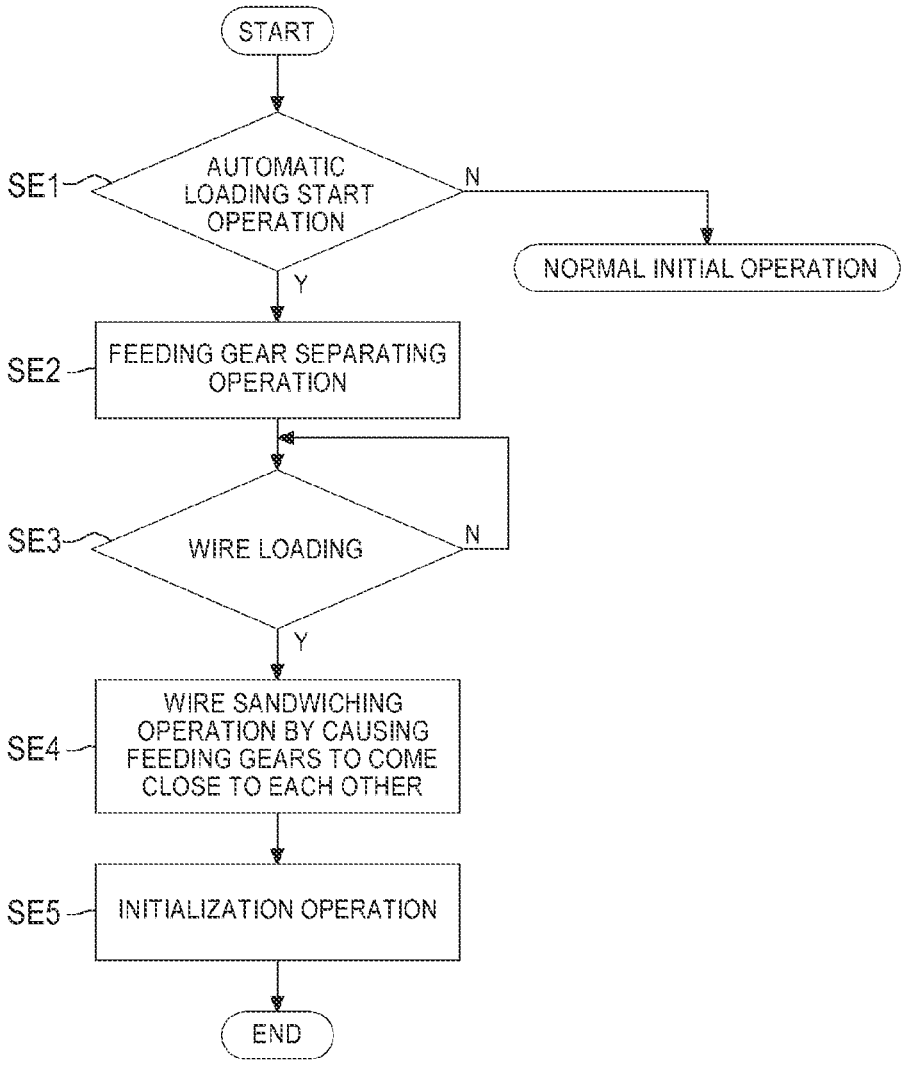
FIG. 8A is a flowchart showing an example of operations of loading and discharging a wire in the reinforcing bar binding machine.
Figure 8B:
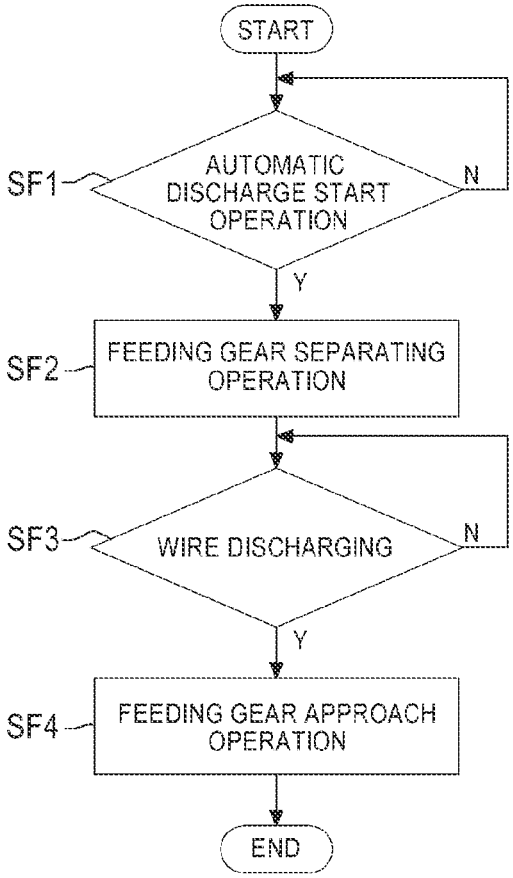
FIG. 8B is a flowchart showing an example of operations of loading and discharging a wire in the reinforcing bar binding machine.

FIGS. 8A and 8B are flowcharts showing an example of operations of enabling the wire to be loaded and discharged in the reinforcing bar binding machine. Subsequently, the operations of enabling the wire to be loaded and discharged in the reinforcing bar binding machine 1B are described.

First, the automatic loading operation shown in FIG. 8A is described. When it is determined in step SE1 of FIG. 8A that a predetermined automatic loading start operation has been performed, the control unit 14B drives the drive unit 39 to displace the second feeding gear 30R away from the first feeding gear 30L, in step SE2.

The user of the reinforcing bar binding machine 1B inserts the reel 20 into the magazine 2A, and guides the tip end of the wire W reeled out from the reel 20 between the first feeding gear 30L and the second feeding gear 30R of the wire feeding unit 3A. When the wire W is loaded between the first feeding gear 30L and the second feeding gear 30R and a predetermined operation of sandwiching the wire W is performed in step SE3, the control unit 14B drives the drive unit 39 to displace the second feeding gear 30R toward the first feeding gear 30L, thereby sandwiching the wire W between the first feeding gear 30L and the second feeding gear 30R, in step SE4. Note that, a sensor configured to detect that the wire W is inserted between the first feeding gear 30L and the second feeding gear 30R may be provided, and when the sensor detects that the wire W is inserted between the first feeding gear 30L and the second feeding gear 30R, the control unit 14B may perform control of driving the drive unit 39 to displace the second feeding gear 30R toward the first feeding gear 30L.

When the control unit 14B displaces the second feeding gear 30R toward the first feeding gear 30L, the control unit 14B performs an initialization operation of driving the feeding motor 33 and the motor 80 to position a position of the tip end of the wire W to a predetermined position, in step SE5 of FIG. 8A.

Subsequently, the automatic discharge operation shown in FIG. 8B is described. When it is determined in step SF1 of FIG. 8B that the predetermined automatic discharge start operation has been performed, the control unit 14B drives the drive unit 39 to displace the second feeding gear 30R away from the first feeding gear 30L, in step SF2. Thereby, it is possible to pull out the wire W from between the first feeding gear 30L and the second feeding gear 30R.

When the wire W is discharged from between the first feeding gear 30L and the second feeding gear 30R and the predetermined operation of displacing the first feeding gear 30L and the second feeding gear 30R toward each other is performed, the control unit 14B drives the drive unit 39 to displace the second feeding gear 30R toward the first feeding gear 30L, in step SF3. Note that, a sensor configured to detect that the wire W comes off from between the first feeding gear 30L and the second feeding gear 30R may be provided, and when the sensor detects that the wire W comes off from between the first feeding gear 30L and the second feeding gear 30R, the control unit 14B may perform control of driving the drive unit 39 to displace the second feeding gear 30R toward the first feeding gear 30L.

<Example of Operational Effects of Reinforcing Bar Binding Machine>

In the binding machine of the related art, a person operates the pair of feeding gears 30 to separate the same from each other, thereby performing loading and discharge of the wire W. In a state where the wire W is wound around the reinforcing bars S, when feeding the wire W in the reverse direction to wind the same on the reinforcing bars S, the wire W can be securely wound on the reinforcing bars S by increasing the force of feeding the wire W.

As for the wire feeding unit 3A, in a configuration where the two wires W are fed, the two wires W are fed aligned in parallel by the friction force generated between the groove portions 32L of the first feeding gear 30L and one wire W, the friction force generated between the groove portions 32R of the second feeding gear 30R and the other wire W and the friction force generated between one wire W and the other wire W.

In order to obtain the friction force enough to feed the wire W, it is necessary to increase a force of the spring for pressing the pair of feeding gears 30 in a direction of coming close to each other. However, when the force of the spring for pressing the pair of feeding gears 30 in a direction of coming close to each other is increased, it is difficult to move the pair of feeding gears 30 in a direction of separating from each other by human force.

Therefore, the reinforcing bar binding machine 1A is configured to perform the automatic loading and the automatic discharge operation. Thereby, it is possible to load and discharge the wire W without moving the pair of feeding gears 30 away from each other with human force. Therefore, it is possible to securely wind the wire W on the reinforcing bars S by increasing the force of the spring 38 for pressing the pair of feeding gears 30 toward each other to increase the force of feeding the wire W.

Further, in the automatic loading operation, the feeding motor 33 is rotated at the first speed until the wire W is sandwiched by the pair of feeding gears 30, and when the wire W is sandwiched by the pair of feeding gears 30, the feeding motor 33 is rotated at the second speed higher than the first speed to feed the wire W sandwiched by the pair of feeding gears 30 to the predetermined position in the forward direction. Thereby, it is possible to securely sandwich the wire W between the pair of feeding gears 30 not separated from each other. After sandwiching the wire W between the pair of feeding gears 30, the time during which the wire W is fed to the predetermined position can be shortened to shorten the time for the automatic loading operation.

Further, before performing the automatic loading operation, the automatic discharge operation may be performed so as to exclude a state in which the wire W is sandwiched between the pair of feeding gears 30, and then the automatic loading operation may be started.

Further, the operation of sandwiching the wire W between the pair of feeding gears 30 by displacing one or both of the pair of feeding gears 30 toward each other and the operation of causing the wire W to come off from between the pair of feeding gears 30 by displacing one or both of the pair of feeding gears 30 away from each other are performed by the drive unit 39 such as a motor, so as to load and discharge the wire W. In this case, it is not necessary to perform the operation of displacing one or both of the pair of feeding gears 30 toward or away from each other by human force.

Modified Embodiment of Reinforcing Bar Binding Machine

Figure 9A:
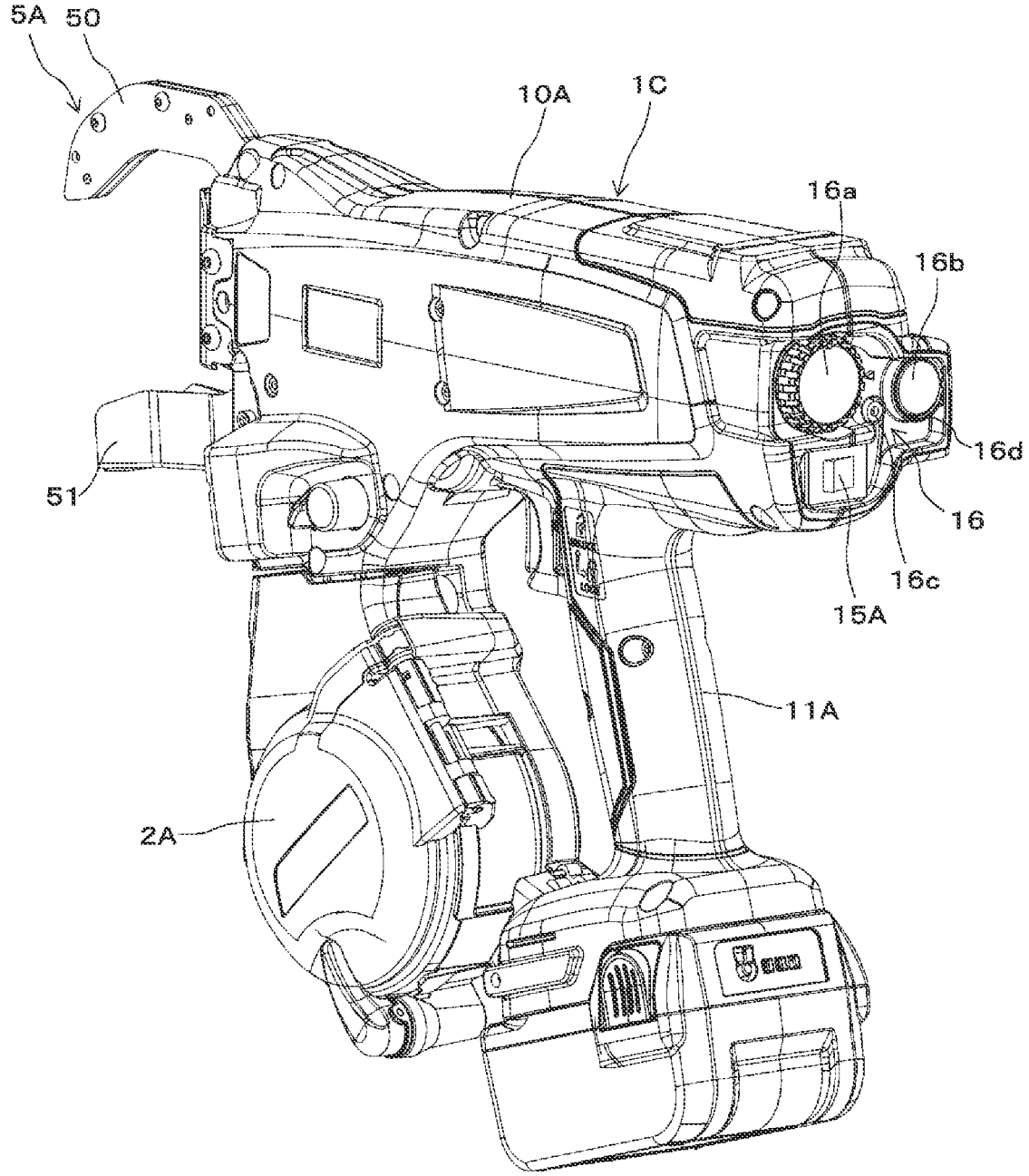
FIG. 9A is a perspective view showing an example of an entire configuration of a modified embodiment of the reinforcing bar binding machine.
Figure 9B:
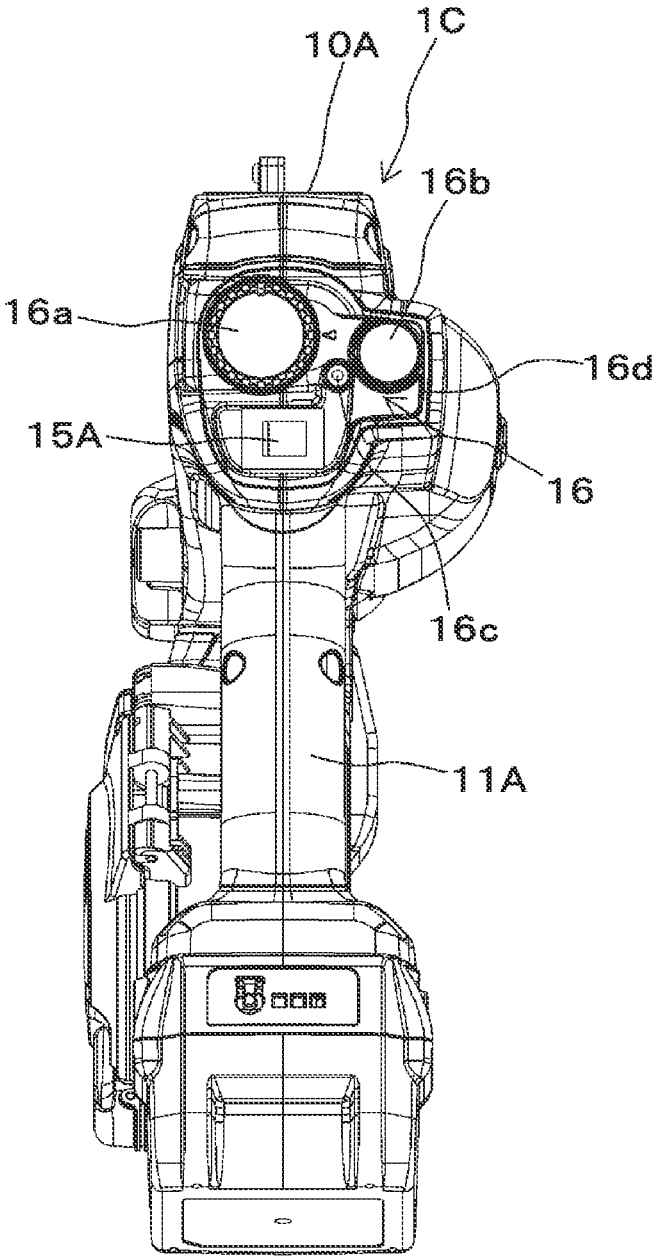
FIG. 9B is a rear view showing the example of the entire configuration of the modified embodiment of the reinforcing bar binding machine.
Figure 9C:
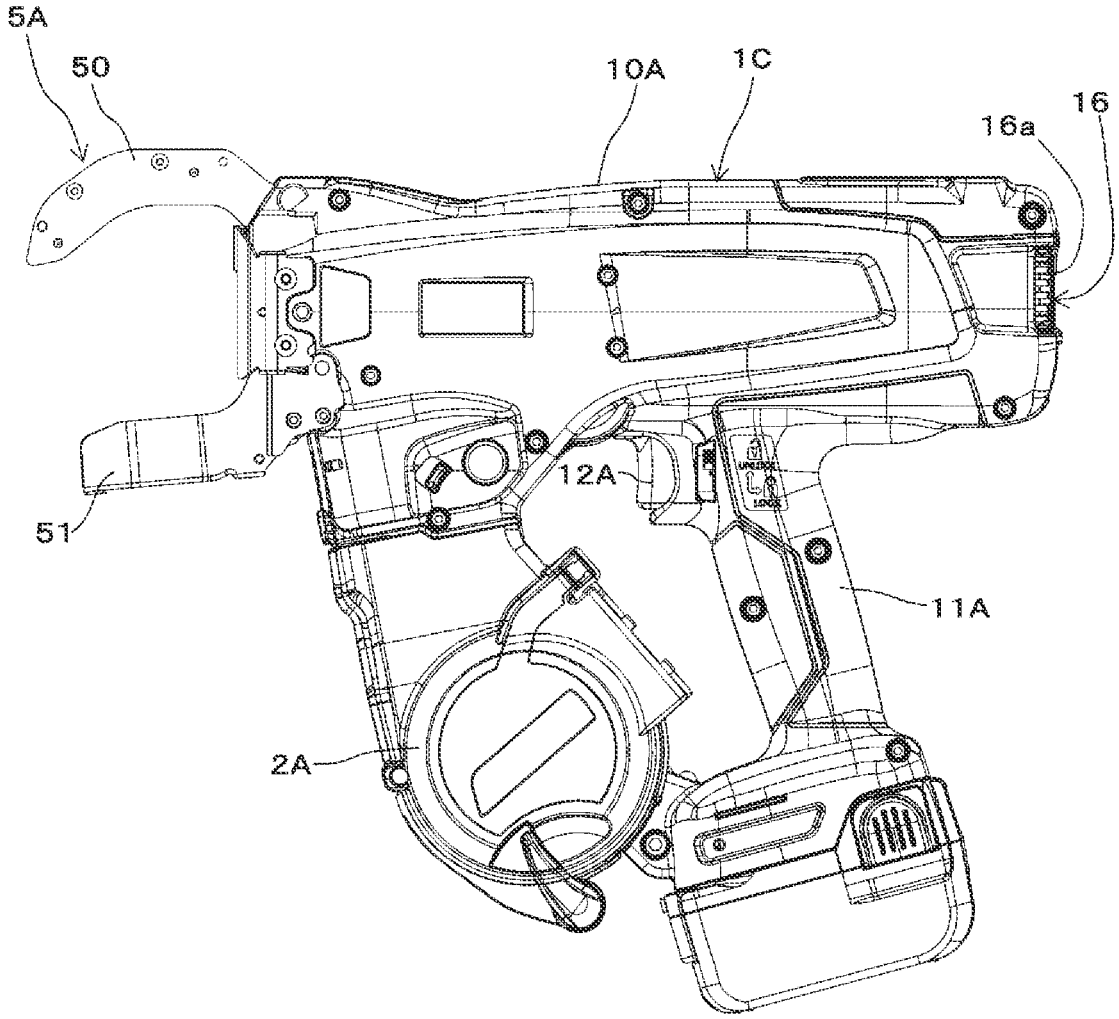
FIG. 9C is a side view showing the example of the entire configuration of the modified embodiment of the reinforcing bar binding machine.
Figure 10A:
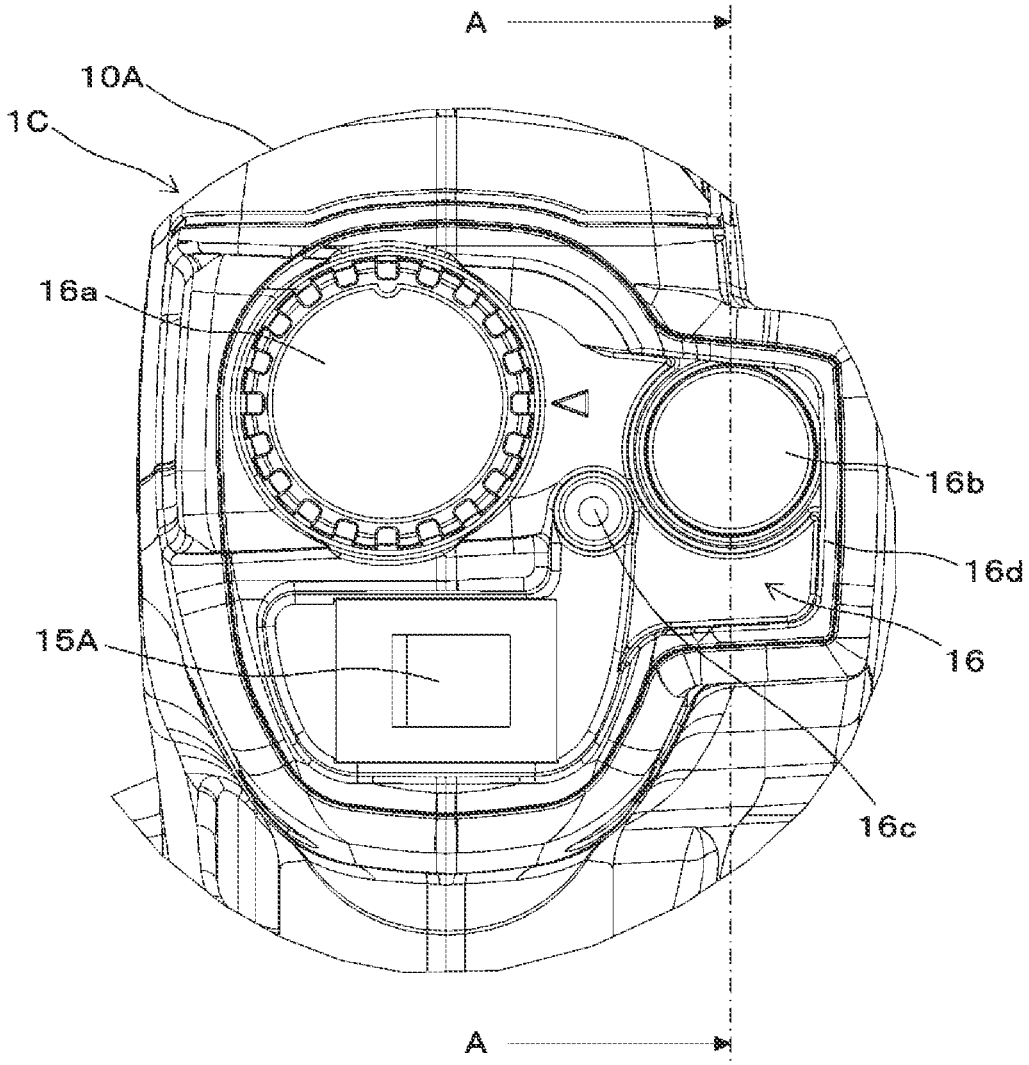
FIG. 10A is a rear view showing an example of a main part configuration of the modified embodiment of the reinforcing bar binding machine.

FIG. 9A is a perspective view showing an example of an entire configuration of a reinforcing bar binding machine of a modified embodiment, FIG. 9 is a rear view showing the example of the entire configuration of the reinforcing bar binding machine of the modified embodiment, and FIG. 9C is a side view showing the example of the entire configuration of the reinforcing bar binding machine of the modified embodiment. FIG. 10A is a rear view showing an example of a main part configuration of the reinforcing bar binding machine of the modified embodiment, and FIG. 10B is a sectional view taken along an A-A line of FIG. 10A.

A reinforcing bar binding machine 1C of the modified embodiment includes an operation unit 16 configured to receive operations for executing turning on and off of a power supply, setting of binding strength by the wire W, automatic loading and automatic discharge of the wire W, and the like. The operation unit 16 is provided on a back surface of the main body part 10A, and has a binding force setting unit capable of selling binding strength by the wire W and the power supply switch 15A. As an example of the binding force setting unit, a torque dial 16*a* capable of selecting binding strength by the wire W is provided. Also, the operation unit 16 has an automatic loading/discharge switch 16*b* configured to execute automatic loading and automatic discharge, and a notification unit 16*c* configured to indicate a state of the reinforcing bar binding machine 1C.

The operation unit 16 has a convex portion 16*d* protruding to the rear of the main body part 10A around the torque dial 16*a*, the power supply switch 15A, the automatic loading/discharge switch 16*b* and the notification unit 16*c*, so that positions in which the torque dial 16*a*, the power supply switch 15A, the automatic loading/discharge switch 16*b* and the notification unit 16*c* are provided have a concave shape. Thereby, as shown in FIG. 9C, the torque dial 16*a*, the power supply switch 15A and the automatic loading/discharge switch 16*b* do not protrude to the rear of the main body part 10A, so that malfunctions are suppressed. In addition, since the discharge and loading of the wire W are performed after the power supply is turned off and on, the operability is improved by providing the automatic loading/discharge switch 16*b* near the power supply switch 15A, in the present example, for the same operation unit 16.

Figure 10B:
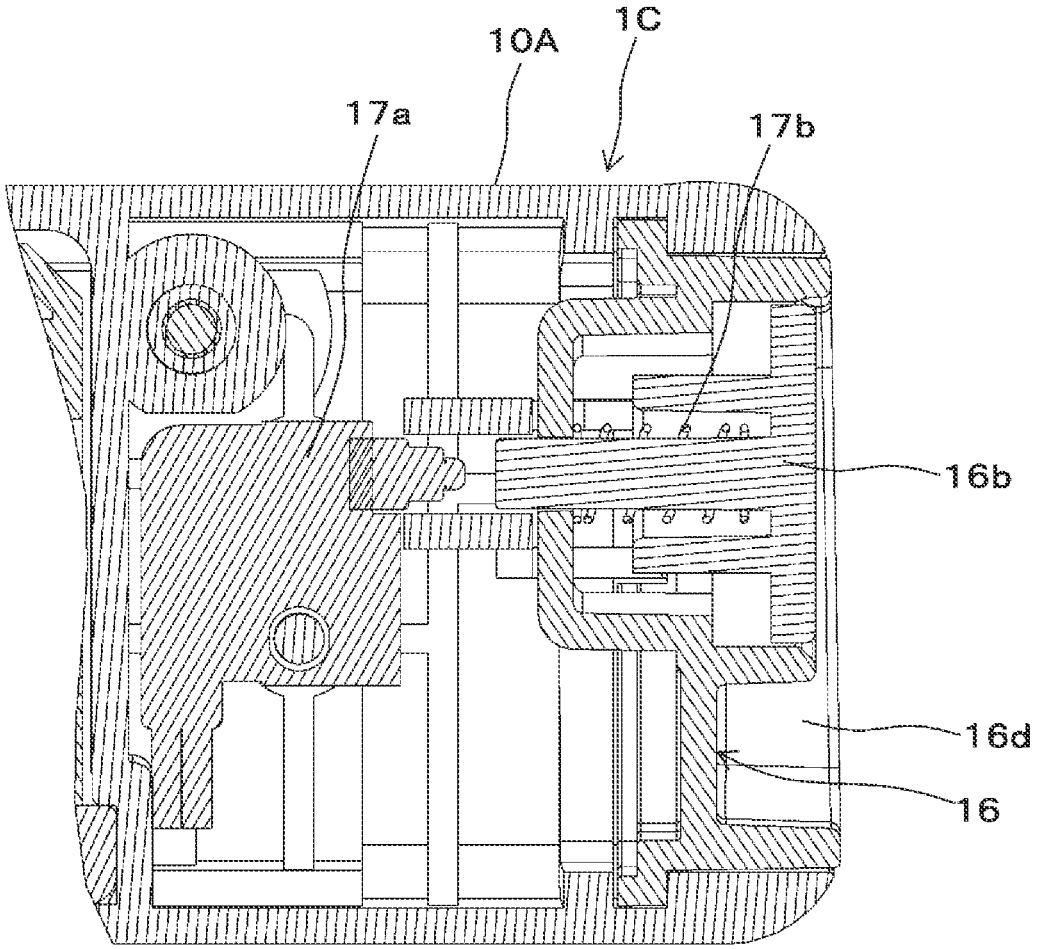
FIG. 10B is a cross-sectional view taken along line A-A in FIG. 10A.

In the present example, the automatic loading/discharge switch 16*b* is a pushing button-type switch, and is configured to actuate a microswitch 17*a* by pressing, as shown in FIG. 10B. The automatic loading/discharge switch 16*b* is urged away from the microswitch 17*a* by a spring 17*b*, thereby switching a state between an operation state and a non-operation state.

Figure 11:
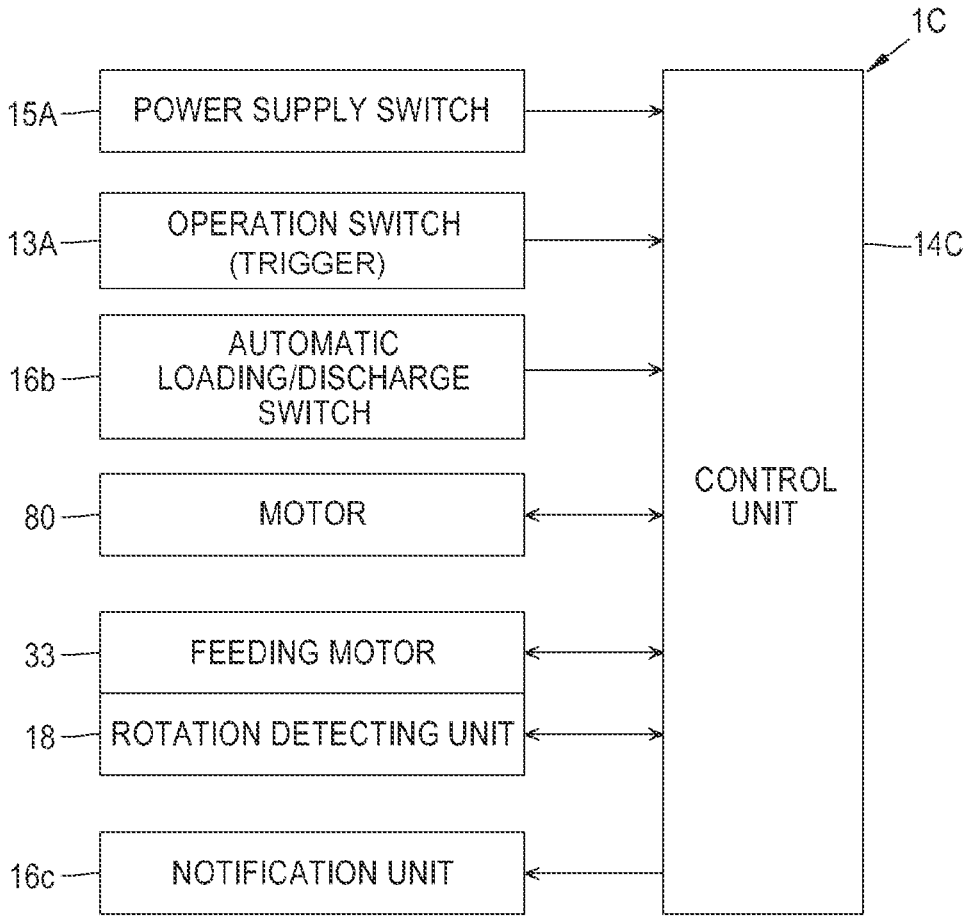
FIG. 11 is a block diagram showing an example of a control function of the modified embodiment of the reinforcing bar binding machine.

FIG. 11 is a block diagram showing an example of a control function of the reinforcing bar binding machine 1C of the modified embodiment. In the reinforcing bar binding machine 1C, the control unit 14C is configured to control the motor 80 and the feeding motor 33 to execute a series of operations of binding the reinforcing bars S with the wire W, according to a state of the operation switch 13A that is pushed as a result of an operation on a trigger 12A shown in FIG. 9C and the like. The control unit 14C is also configured to switch on and off states of the power supply, according to an operation on the power supply switch 15A. The control unit 14C is also configured to control the feeding motor 33 to perform loading and discharge of the wire W in the wire feeding unit 3A, based on an output of the microswitch 17*a* resulting from an operation on the automatic loading/discharge switch 16*b*.

In the present example, the feeding motor 33 is constituted by a brushless motor, and has a rotation detecting unit 18 such as a Hall IC configured to detect rotating positions of a rotor. In the wire feeding unit 3A, the driving force transmission mechanism 34 configured to transmit a drive force of the feeding motor 33 to the first feeding gear 30L is constituted by a spur gear. Thereby, when a tip end of the wire W is put between the groove portions 32L of the first feeding gear 30L and the groove portions 32R of the second feeding gear 30R and the wire W is pushed, the feeding motor 33 can be rotated with an external force by behaviors (rotations) of the first feeding gear 30L and the second feeding gear 30R in a state where rotation of the feeding motor 33 by energization is not performed. That is, the rotation detecting unit 18 constitutes a detection unit configured to detect movement of the first feeding gear 30L and the second feeding gear 30R by behaviors thereof.

When the power supply is turned on as a result of an operation on the power supply switch 15A, the control unit 14C switches the notification unit 16*c* from a lights-out state to a lighting state, thereby notifying an on-state of the power supply (power supply ON) and a binding standby state. When the microswitch 17*a* is pushed due to an operation on the automatic loading/discharge switch 16*b*, the control unit 14C executes an automatic discharge mode of performing a discharge operation of the wire W and an automatic loading mode of performing a loading operation of the wire W. When the automatic discharge mode is executed, the control unit 14C switches the notification unit I6*c* from the lighting state to a blinking state, thereby notifying that the automatic discharge mode is being executed. Also, when the automatic loading mode is executed, the control unit 14C switches the notification unit 16*c* from the lighting state to the blinking state, thereby notifying that the automatic loading mode is being executed. Further, in an operation of continuously executing the automatic discharge mode and the automatic loading mode, the control unit 14C switches the notification unit 16*c* from the lighting state to the blinking state, thereby notifying that the automatic loading/discharge mode is being executed. The notification unit 16*c* is constituted by a lamp such as an LED but may also be a display unit such as a display. In addition, the notification unit 16*c* may be a buzzer configured to output a sound, and may output a buzzer sound while the automatic discharge mode, the automatic loading mode or the automatic loading/discharge mode is executed.

When the automatic discharge mode or the automatic discharge mode in the automatic loading/discharge mode is executed, the control unit 14C rotates the feeding motor 33 in the reverse direction. When the feeding motor 33 is rotated in the reverse direction by a prescribed rotating amount by which the wire W comes off from the feeding gear 30, the control unit 14C stops the feeding motor 33.

When the automatic loading mode or the automatic loading mode in the automatic loading/discharge mode is executed, if the rotation detecting unit 18 detects that the feeding motor 33 is rotated in a state where rotation of the feeding motor 33 by energization is not performed, the control unit 14C rotates the feeding motor 33 in the forward direction. When the feeding motor 33 is rotated in the forward direction by a prescribed rotating amount by which the wire W is first fed from the feeding gear 30, the control unit 14C stops the feeding motor 33.

When the microswitch 17*a* is pushed as a result of an operation on the automatic loading/discharge switch 16*b* and the automatic loading mode or the automatic loading/discharge mode is executed, the control unit 14C starts to measure time, and notifies that the automatic loading mode or the automatic loading/discharge mode is being executed by blinking the notification unit 16*c* until a prescribed time, which is a timeout of the automatic loading mode or the automatic loading/discharge mode, elapses.

Until the prescribed time, which is a timeout of the automatic loading/discharge mode, elapses, when the rotation detecting unit 18 detects that the feeding motor 33 is rotated in the state where rotation of the feeding motor 33 by energization is not performed, the control unit 14C executes the loading operation. On the other hand, when the prescribed time, which is a timeout of the automatic loading/discharge mode, elapses, the control unit 14C switches the notification unit 16*c* from the lights-out state to the lighting state, and does not execute the loading operation even though the rotation detecting unit 18 detects that the feeding motor 33 is rotated in the state where rotation of the feeding motor 33 by energization is not performed.

In addition, after the automatic loading/discharge mode starts as the automatic loading/discharge switch 16*b* is pushed (first operation), when the automatic loading/discharge switch 16*b* is pushed (second operation) before the prescribed time, which is a timeout of the automatic loading/discharge mode, elapses, the control unit 14C switches the notification unit 16*c* from the blinking state to the lighting state and sets the binding standby state. Note that, in the configuration where the presence or absence of execution of the automatic loading/discharge mode and the like is notified through lighting, blinking, lights-out and the like of the notification unit 16*c* by the lamp, the combination of lighting, blinking and lights-out is not limited to the above example. In addition, the blinking pattern may also be changed.

Figure 12:
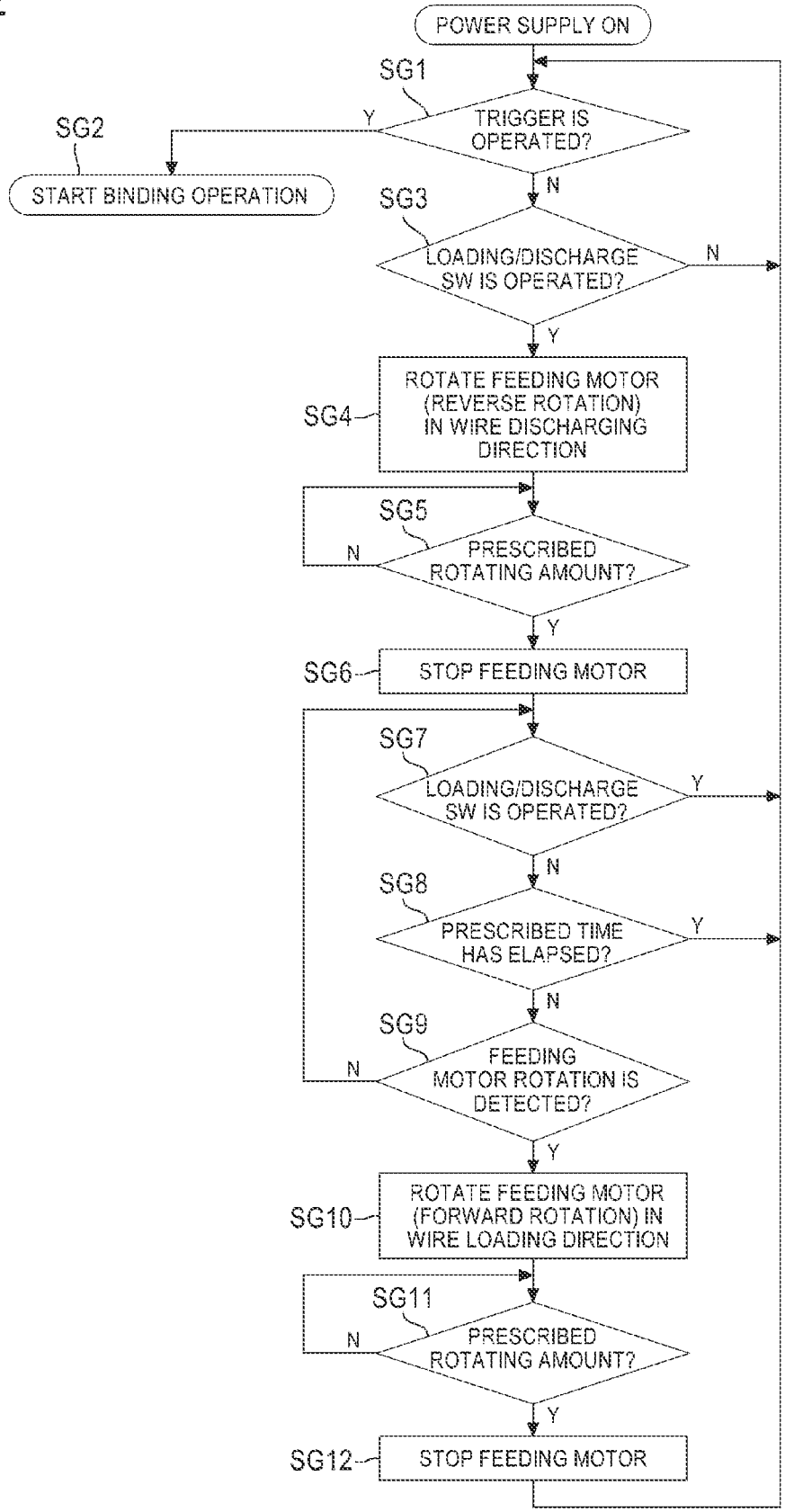
FIG. 12 is a flowchart showing an example of operations of loading and discharging a wire in the modified embodiment of the reinforcing bar binding machine.

FIG. 12 is a flowchart showing an example of an operation of loading and discharging the wire in the reinforcing bar binding machine of the modified embodiment. When the power supply is turned on as a result of an operation on the power supply switch 15A, the control unit 14C determines whether the trigger 12A is operated, in step SG1 of FIG. 11. When it is determined that the trigger 12A is operated, the control unit 14C executes the binding operation, in step SG2.

When it is determined that the trigger 12A is not operated, the control unit 14C determines whether the automatic loading/discharge switch 16*b* is operated, in step SG3. When it is determined that the automatic loading/discharge switch 16*b* is operated (there is an operation on the loading/discharge SW), the control unit 14C executes the automatic loading/discharge mode, and notifies that the automatic loading/discharge mode is being executed by switching the notification unit 16*c* from the lighting state to the blinking state while the automatic loading/discharge mode is executed. In addition, when the control unit 14C executes the automatic loading/discharge mode, the control unit 14C rotates the feeding motor 33 in the reverse direction in which the wire W is discharged, in step SG4.

When the control unit 14C rotates the feeding motor 33 in the reverse direction by the prescribed rotating amount by which the wire W comes off from the feeding gear 30, in step SG5, the control unit 14C stops the feeding motor 33 in step SG6.

When the automatic loading/discharge switch 16*b* is again operated (there is an operation on the loading/discharge SW) while the automatic loading/discharge mode is executed, in step SG7, the control unit 14C ends the automatic loading/discharge mode, and switches the notification unit 16*c* from the blinking state to the lighting state. When it is determined that the automatic loading/discharge switch 16*b* is not again operated (there is no operation on the loading/discharge SW) while the automatic loading/discharge mode is executed, in step SG7, and the prescribed time, which is a timeout of the automatic loading/discharge mode, has not elapsed, in step SG8, the control unit 14C determines whether the feeding motor 33 is rotating, in step SG9.

When the rotation detecting unit 18 detects that the feeding motor 33 is rotating in the state where rotation of the feeding motor 33 by energization is not performed, the control unit 14C determines that the feeding motor 33 is rotating by the external force, and rotates the feeding motor 33 in the forward direction in which the wire W is loaded, in step SG10.

When the control unit 14C rotates the feeding motor 33 in the forward direction by the prescribed rotating amount by which the wire W is first fed from the feeding gear 30, in step SG11, the control unit 14C stops the feeding motor 33 in step SG12.

Note that, after stopping the feeding of the wire W in the forward direction by stopping the drive of the feeding motor 33, a so-called initializing operation of positioning a position of the tip end of the wire W to a predetermined position may be performed.

In the present modified embodiment, when the rotation detecting unit 18 detects the rotation of the feeding motor 33 by detecting the movement due to the behavior of the feeding members, the feeding motor 33 is rotated in the forward direction. However, the rotation detecting unit 18 may also be configured to detect the rotation of at least one of the pair of feeding gears 30, when the rotation of the feeding gear 30 is detected, the feeding motor 33 may be rotated in the forward direction.

In addition, the automatic loading/discharge switch 16*b* is configured independently of other switches of the operation unit 16 but may also be used as other switches of the operation unit 16. For example, the torque dial 16*a* may be configured to output a signal by rotation and to output a signal by pressing, and when the torque dial 16*a* is pressed, the automatic loading/discharge mode and the like may be executed. Further, a switch for executing the automatic discharge mode and a switch for executing the automatic loading mode may be independently provided.

What is claimed is:

1. A binding machine comprising:

a wire feeding unit configured to feed a wire;

a curl guide arranged along a loop feeding path of the wire along which the wire fed in a first direction by the wire feeding unit is wound around an object; and a binding unit which includes a rotary shaft to twist the wire fed in the first direction by the wire feeding unit and wound on the object, wherein the wire feeding unit comprises a pair of feeding members and a feeding motor that drives the feeding members, the pair of feeding members having a cylindrical outer surfaces, being arranged such that the outer surfaces face each other with a feeding path of the wire being interposed therebetween, and being configured to rotate in mutually opposite directions so as to feed the wire sandwiched between the outer surfaces, wherein the binding machine further comprises a control circuit configured to control the wire feeding unit, wherein the control circuit is configured to control the wire feeding unit to discharge the wire sandwiched by the feeding members from the feeding members in a second direction opposite to the first direction, wherein the control circuit is configured to control the feeding motor to feed the wire sandwiched by the feeding members in the second direction opposite to the first direction until the wire comes off from the feeding members, and wherein the control circuit is configured to detect a value of current flowing through the feeding motor, to detect variation in load that is applied to the feeding motor based on the detected value of current flowing through the feeding motor, and to determine that the wire comes off from the feeding members to stop the feeding motor that feeds the wire in the second direction, based on variation in load that is applied to the feeding motor or based on a rotating amount of the feeding motor.

2. The binding machine according to claim 1, wherein the control circuit is configured to control the feeding motor based on an operation on an operation unit to feed the wire sandwiched by the feeding members in the second direction opposite to the first direction until the wire comes off from the feeding members.

3. The binding machine according to claim 1, wherein the control circuit is configured to detect a value of current flowing through the feeding motor, to detect variation in load that is applied to the feeding motor based on the detected value of current flowing through the feeding motor, and to rotate the feeding motor in a rotating direction of feeding the wire in the second direction, based on a detected variation in load, or the control circuit is configured to rotate the feeding motor in a rotating direction of feeding the wire in the second direction, based on a detection result of a sensor whether a rear end of the wire fed in the first direction is detected, the sensor being provided on the feeding path between the wire feeding unit and a magazine for accommodating the wire therein.

4. The binding machine according to claim 1, wherein the control circuit is configured to rotate the feeding motor in a rotating direction of feeding the wire in the first direction and to sandwich the wire by the feeding members, based on an operation on an operation unit, or the control circuit is configured to rotate the feeding motor in a rotating direction of feeding the wire in the first direction and to sandwich the wire by the feeding members, based on a detection result of a sensor whether a tip end of the wire fed in the first direction is detected, the sensor being provided on the feeding path between the wire feeding unit and a magazine for accommodating the wire therein.

5. The binding machine according to claim 4, wherein the control circuit is configured to detect a value of current flowing through the feeding motor, to detect variation in load that is applied to the feeding motor based on the detected value of current flowing through the feeding motor, and to change a rotating speed of the feeding motor that feeds the wire in the first direction, based on variation in load that is applied to the feeding motor.

6. The binding machine according to claim 5, wherein the control circuit is configured to rotate the feeding motor at a first speed until the wire is sandwiched by the feeding members, and to rotate the feeding motor at a second speed higher than the first speed when the wire is sandwiched by the feeding members, thereby feeding the wire sandwiched by the feeding members in the first direction.

7. The binding machine according to claim 4, further comprising an indicator that notify a state, wherein the control circuit is configured to notify an operation mode of loading the wire by the indicator.

8. The binding machine according to claim 1, further comprising a sensor that detects movement due to rotation of the feeding members, wherein when the control circuit determines that the sensor that detects movement due to the rotation of the feeding members, the control circuit rotates the feeding motor in a rotating direction in which the wire is fed in the first direction, and sandwiches the wire by the feeding members.

9. The binding machine according to claim 8, wherein the sensor is a sensor that detects rotation of the feeding motor, and wherein when the control circuit determines that the sensor detects rotation of the feeding motor, the control circuit rotates the feeding motor in a rotating direction in which the wire is fed in the first direction, and sandwiches the wire by the feeding members.

10. The binding machine according to claim 8, wherein the control circuit is configured to stop the feeding motor that feeds the wire in the first direction, based on a rotating amount of the feeding motor.

11. The binding machine according to claim 1, further comprising an indicator that notifies a state, wherein the control circuit is configured to notify an operation mode of discharging the wire based on the indicator.

12. The binding machine according to claim 1, wherein the pair of feeding members has one feeding member and the other feeding member, at least the one feeding member being displaceable toward and away from the other feeding member, wherein the wire feeding unit comprises:

an actuator that displaces at least the one feeding member, and wherein the control circuit is configured to control the actuator to displace one or both of the one feeding member and the other feeding member away from each other, thereby enabling the wire sandwiched by the one feeding member and the other feeding member to be discharged from between the one feeding member and the other feeding member.

13. The binding machine according to claim 1, wherein the control circuit is configured to control the feeding motor to feed the wire sandwiched by the feeding members in the second direction opposite to the first direction until the wire separates from the feeding members, based on an operation on an operation unit, and to rotate the feeding motor in a rotating direction in which the wire is fed in the first direction to feed the wire in the first direction when the wire sandwiched by the feeding members is discharged from the feeding members.

14. The binding machine according to claim 13, wherein the control circuit is configured to stop the feeding motor that feeds the wire in the second direction, based on a rotating amount of the feeding motor.

15. The binding machine according to claim 13, further comprising a sensor that detects movement due to rotation of the feeding members, wherein when the control circuit determines that the sensor detects movement due to the rotation of the feeding members, the control circuit rotates the feeding motor in a rotating direction in which the wire is fed in the first direction, thereby feeding the wire in the first direction.

16. The binding machine according to claim 15, wherein the sensor is a sensor that detects rotation of the feeding motor, and wherein when the control circuit determines that the sensor detects rotation of the feeding motor, the control circuit rotates the feeding motor in a rotating direction in which the wire is fed in the first direction, thereby feeding the wire in the first direction.

17. The binding machine according to claim 15, wherein the control circuit is configured to stop the feeding motor that feeds the wire in the first direction, based on a rotating amount of the feeding motor.

18. A binding machine comprising:

a wire feeding unit configured to feed a wire;

a curl guide arranged along a loop feeding path of the wire along which the wire fed in a first direction by the wire feeding unit is wound around an object; and a binding unit which includes a rotating shaft to twist the wire fed in the first direction by the wire feeding unit and wound on the object, wherein the wire feeding unit comprises a pair of feeding members and a feeding motor that drives the feeding members, the pair of feeding members having a cylindrical outer surfaces, being arranged such that the outer surfaces face each other with a feeding path of the wire being interposed therebetween, and being configured to rotate in mutually opposite directions so as to feed the wire sandwiched between the outer surfaces, wherein the binding machine further comprises a control circuit configured to control the wire feeding unit, and a sensor that detects movement due to rotation of the feeding members, and wherein the control circuit is configured to automatically rotate the feeding motor in a rotating direction in which the wire is fed in the first direction when the sensor detects movement due to the rotation of the feeding members in a state where the feeding motor is non-energized.

19. A binding machine comprising:

a wire feeding unit configured to feed a wire;

a curl guide arranged along a loop feeding path of the wire along which the wire fed in a first direction by the wire feeding unit is wound around an object;

a cutter that cuts the wire wound around the object; and a binding unit which includes a rotating shaft to twist the wire fed in the first direction by the wire feeding unit and wound on the object, wherein the wire feeding unit comprises a pair of feeding members and a feeding motor that drives the feeding members, the pair of feeding members each having cylindrical outer surfaces, being arranged such that the outer surfaces face each other with a feeding path of the wire being interposed therebetween, and being configured to rotate in mutually opposite directions so as to feed the wire sandwiched between the outer surfaces, wherein the cutter is provided on the feeding path between the wire feeding unit and the binding unit and cut the wire to divide the wire into a part on a side near to the binding unit from the cutter and another part on a side near to the feeding unit from the cutter, wherein the binding machine further comprises a control circuit configured to control the wire feeding unit and the cutter, wherein the control circuit is configured to control the wire feeding unit to enable the another part of the wire cut by the cutter and sandwiched by the feeding members to be discharged from the feeding members, wherein the pair of feeding members has one feeding member and the other feeding member, at least the one feeding member being displaceable toward and away from the other feeding member, wherein the wire feeding unit comprises:

an actuator that displaces at least the one feeding member, and wherein the control circuit is configured to control the actuator to displace one or both of the one feeding member and the other feeding member away from each other, thereby enabling the wire sandwiched by the one feeding member and the other feeding member to be discharged from between the one feeding member and the other feeding member.

* * * * *